US010479095B2

(12) United States Patent
Kobayashi et al.

(10) Patent No.: US 10,479,095 B2
(45) Date of Patent: Nov. 19, 2019

(54) LIQUID CARTRIDGE HAVING CHAMBER AND SET OF THE LIQUID CARTRIDGES

(71) Applicant: BROTHER KOGYO KABUSHIKI KAISHA, Nagoya-shi, Aichi-ken (JP)

(72) Inventors: Tetsuro Kobayashi, Nagoya (JP); Fumio Nakazawa, Okazaki (JP); Hiroaki Takahashi, Nagoya (JP); Akihito Ono, Nagoya (JP); Takahiro Miyao, Nagoya (JP); Suguru Tomoguchi, Okazaki (JP); Kosuke Nukui, Nagoya (JP); Naoya Okazaki, Gifu-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/663,987

(22) Filed: Jul. 31, 2017

(65) Prior Publication Data

US 2018/0178530 A1 Jun. 28, 2018

(30) Foreign Application Priority Data

Dec. 28, 2016 (JP) ..... 2016-255429

(51) Int. Cl.
*B41J 2/175* (2006.01)

(52) U.S. Cl.
CPC ..... *B41J 2/17513* (2013.01); *B41J 2/175* (2013.01); *B41J 2/1752* (2013.01); *B41J 2/1753* (2013.01); *B41J 2/17509* (2013.01); *B41J 2/17523* (2013.01); *B41J 2/17526* (2013.01); *B41J 2/17553* (2013.01)

(58) Field of Classification Search
CPC ..... B41J 2/17503; B41J 2/17513; B41J 2/17526; B41J 2/17553
See application file for complete search history.

(56) References Cited

U.S. PATENT DOCUMENTS

2008/0230141 A1* 9/2008 Hattori ..... B41J 2/17506 141/18
2011/0234717 A1 9/2011 Sakurai
2014/0055535 A1* 2/2014 Takagi ..... B41J 2/1752 347/86
2016/0059572 A1* 3/2016 Kobayashi ..... B41J 2/17513 347/86

FOREIGN PATENT DOCUMENTS

JP 2011-201067 A 10/2011

* cited by examiner

*Primary Examiner* — Kristal Feggins
*Assistant Examiner* — Kendrick X Liu
(74) *Attorney, Agent, or Firm* — Merchant & Gould P.C.

(57) ABSTRACT

A liquid cartridge includes: a liquid chamber; a liquid supply portion having a front end part of a liquid supply hole; a front wall and a rear wall away from the front wall in a rearward direction; a bottom wall extending between the front and the rear walls; a sub front wall; and a sub bottom wall extending between the front wall and the sub front wall. The sub front wall faces frontward and is positioned closer to the front wall than to the rear wall. The sub bottom wall is positioned upward relative to the liquid supply portion. The front wall is positioned frontward relative to the front end part of the liquid supply hole. The front wall has a length in an upward direction longer than a length of the sub front wall in the upward direction in an upright posture.

16 Claims, 14 Drawing Sheets

LIQUID CARTRIDGE HAVING CHAMBER AND SET OF THE LIQUID CARTRIDGES

CROSS REFERENCE TO RELATED APPLICATION

This application claims priority from Japanese Patent Application No. 2016-255429 filed Dec. 28, 2016. The entire content of the priority application is incorporated herein by reference.

TECHNICAL FIELD

The present disclosure relates to a liquid cartridge having a chamber and a set of the liquid cartridges.

BACKGROUND

There are known printers provided with a recording head that ejects ink supplied from an ink cartridge through a nozzle. Such printers can attach thereto a large capacity ink cartridge and a small capacity ink cartridge, which are cartridges different in the amount of ink that can be stored. The large capacity ink cartridge has the front-rear length in the front-rear direction, i.e., length between the front and rear walls of the cartridge, which is larger than the front-rear length of the small capacity cartridge. As a result, the capacity of a tank formed between the front and rear walls of the large capacity ink cartridge is larger than the capacity of a tank formed between the front and rear walls of the small capacity ink cartridge. Each of the large and small capacity ink cartridges includes an ink supply port having an open front end.

SUMMARY

By inserting the large capacity ink cartridge or small capacity ink cartridge is inserted horizontally into the printer with the front wall positioned frontward of the rear wall, a tubular ink needle is inserted into the ink supply port. This allows ink to flow out of the tank of any one of the ink cartridges inserted into the printer. It is important for a connecting part between the ink needle and the ink supply port to be kept water-tight for preventing ink leakage. Specifically, when the capacity of a tank is increased, the weight of an ink cartridge is increased, so that the weight of ink stored in the tank is increased. Further, as the center of gravity of an ink cartridge having a comparatively large weight is positioned farther from the connecting part in the horizontal direction, a rotational moment applied to the connecting part becomes larger. When the rotational moment acts on the ink needle, the ink needle may be twisted with respect to the horizontal direction. As a result, a gap occurs between the ink needle and ink supply port, thereby easily causing liquid leakage.

Alternatively, the front-rear direction length from the front wall to the ink supply port of the large capacity ink cartridge is the same as that of the small capacity ink cartridge, while the length from the rear wall to the ink supply port in the front-rear direction is different between the large and small capacity ink cartridges. Thus, in a state where the both ink cartridges are attached to the printer, the rear wall of the small capacity ink cartridge is positioned frontward of the rear wall of the large capacity ink cartridge. As a result, the small capacity ink cartridge positioned at the depth side (front side in the insertion direction) is hard to remove from the printer. In a configuration in which the rear wall has translucency, a liquid surface of ink stored in the tank may be hard to be visible through the rear wall.

The present disclosure has been made in view of at least one of the above situations, and a possible object thereof is to provide an ink cartridge having a configuration that can prevent the liquid from leaking from the connecting part between a tubular member of a cartridge attachment part and a liquid supply port even when the storable liquid amount is increased.

Another possible object of the present disclosure is to provide a cartridge set of liquid cartridges having different capacities that have rear walls at the same positions in a state of being attached to an image recording apparatus.

According to one aspect, the disclosure provides a liquid cartridge including a liquid chamber configured to store liquid; a liquid supply portion having a front end part formed with a liquid supply hole through which the liquid is configured to flow out from the liquid chamber in a frontward direction crossing a gravitational direction in an upright posture; a front wall and a rear wall away from the front wall in a rearward direction opposite to the frontward direction in the upright posture; a bottom wall extending between the front wall and the rear wall; a sub front wall at which the liquid supply portion is provided; and a sub bottom wall extending between the front wall and the sub front wall in the frontward direction. The sub front wall faces frontward and is positioned closer to the front wall in the frontward direction than to the rear wall. The sub bottom wall is positioned upward relative to the liquid supply portion. The front wall is positioned frontward relative to the front end part of the liquid supply hole. The front wall has a length in an upward direction longer than a length of the sub front wall in the upward direction in the upright posture. The upward direction is opposite to the gravitational direction.

According to another aspect, the disclosure provides a set of plurality of cartridges including a liquid cartridge and a small capacity liquid cartridge configured to store the liquid less than the liquid stored in the liquid cartridge. The liquid cartridge includes: a first liquid chamber configured to store liquid; a first liquid supply portion having a first front end part formed with a first liquid supply hole through which the liquid is configured to flow out from the first liquid chamber in a frontward direction crossing a gravitational direction in an upright posture; a first front wall and a first rear wall away from the first front wall in a rearward direction opposite to the frontward direction in the upright posture; a first bottom wall extending between the first front wall and the first rear wall; a first sub front wall at which the first liquid supply portion is provided; and a first sub bottom wall extending between the first front wall and the first sub front wall in the frontward direction. The first sub bottom wall is positioned upward relative to the first liquid supply portion. The first front wall is positioned frontward relative to the first front end part of the first liquid supply hole. The first front wall has a length in an upward direction longer than a length of the first sub front wall in the upward direction in the upright posture. The upward direction is opposite to the gravitational direction. The first sub front wall faces frontward and is positioned closer to the first front wall in the frontward direction than to the first rear wall. The small capacity liquid cartridge includes: a second liquid chamber configured to store liquid; a second liquid supply portion having a second front end part formed with a second liquid supply hole through which the liquid is configured to flow out from the second liquid chamber in the frontward direction in the upright posture; a second front wall and a second rear wall away from the second front wall in the rearward direction in the upright posture; a second bottom wall extending between the second front wall and the second rear wall; a second sub front wall at which the second liquid supply portion is provided; and a second sub bottom wall extending between the second front wall and the second sub front wall in the frontward direction. The second sub bottom wall is positioned upward relative to the second liquid supply portion. The second front wall is positioned frontward relative to the second front end part of the second liquid supply hole. The second front wall has a length in an upward direction longer than a length of the second sub front wall in the upward direction in the upright posture. The first front wall and the first liquid supply hole have a length therebetween in the frontward direction longer than a length between the second front wall and the second liquid supply hole in the frontward direction. The second sub front wall faces frontward and is positioned closer to the second front wall in the frontward direction than to the second rear wall.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
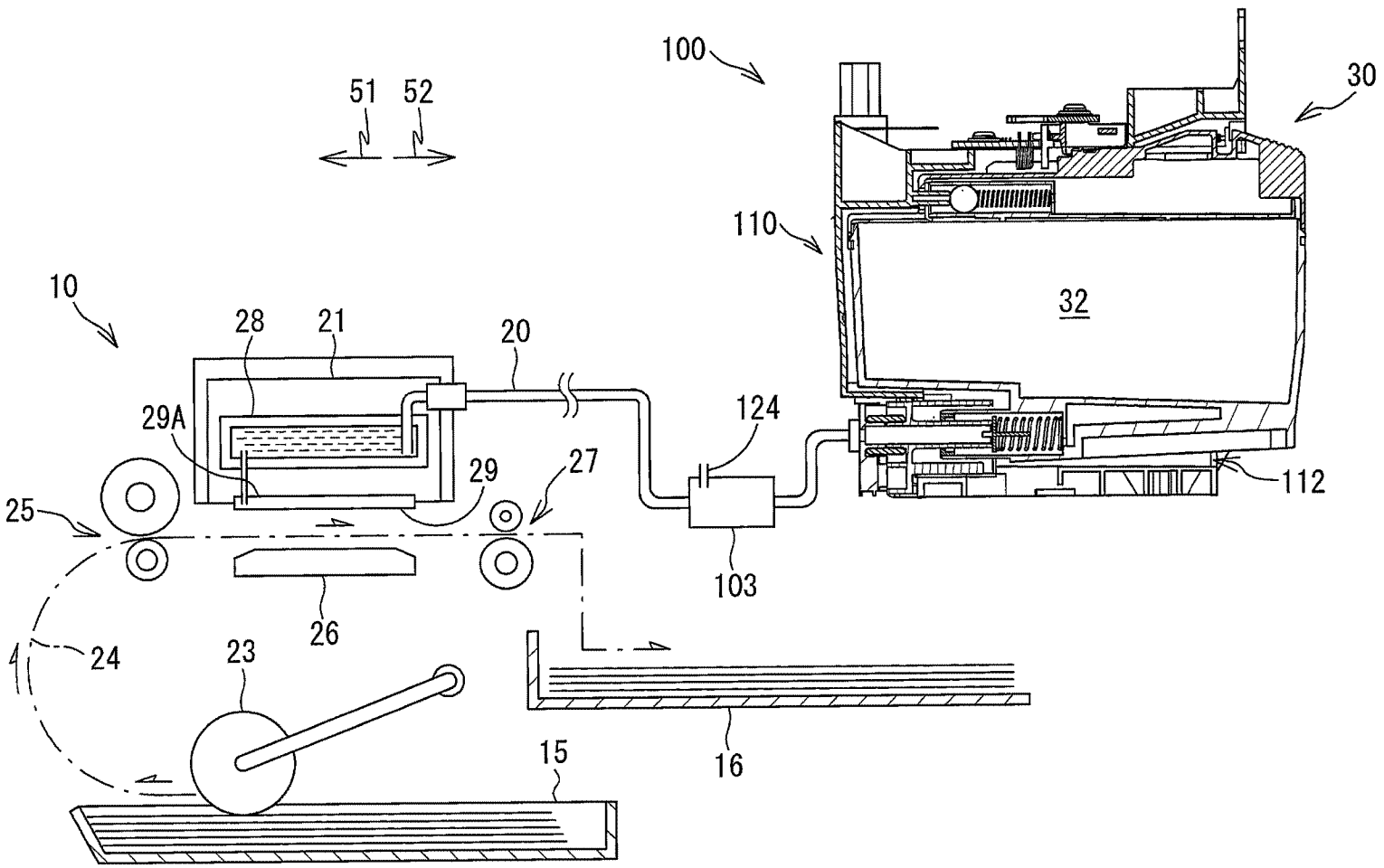
FIG. 1 is a schematic cross-sectional diagram conceptually showing an internal configuration of a printer including a cartridge-attachment section configured to detachably accommodate ink cartridges according to an embodiment.

In the following description, the direction in which an ink cartridge 30 or a small capacity ink cartridge 230 is inserted into a cartridge-attachment section 110 is defined as a frontward direction 51. The direction in which the ink cartridge 30 or small capacity ink cartridge 230 is removed from the cartridge-attachment section 110 is defined as a rearward direction 52. The ink cartridge 30 or small capacity ink cartridge 230 is inserted into and removed from the cartridge-attachment section 110 in the horizontal direction. Thus, the frontward direction 51 and rearward direction 52 are assumed to be horizontal. The direction perpendicular to the frontward direction 51 or rearward direction 52 is defined as a downward direction 53, and the downward direction 53 is substantially coincident with the gravitational direction in a state where the ink cartridge 30 is in an upright posture. The direction opposite to the downward direction 53 is an upward direction 54. The direction perpendicular to both the frontward and downward directions 51 and 53 is defined as a rightward direction 55. The direction opposite to the rightward direction 55 is defined as a leftward direction 56. In the description, in a use state in which the ink cartridge 30 or small capacity ink cartridge 230 is attached to the cartridge-attachment section 110, the gravitational direction is assume to be the downward direction 53, and the direction opposite to the gravitational direction is assumed to be the upward direction 54. That is, in a use state in which the ink cartridge 30 is attached to the cartridge-attachment section 110, the outer surface of a bottom wall 42 of a cartridge body 31 faces downward in the gravitational direction. Similarly, in a use state in which the small capacity ink cartridge 230 is attached to the cartridge-attachment section 110, the outer surface of a second bottom wall 242 of a second cartridge body 231 faces downward in the gravitational direction. Further, the directions perpendicular to both the frontward and rearward directions 51 and 52 are defined as the rightward and leftward directions 55 and 56. More specifically, when the ink cartridge 30 or small capacity ink cartridge 230 is viewed from the rear side in the front-rear direction in a use state where the ink cartridge 30 or small capacity ink cartridge 230 is inserted into the cartridge-attachment section 110, the direction facing the right side is defined as the rightward direction 55, and the direction facing the left side is defined as the leftward direction 56. Incidentally, the use state where the ink cartridge 30 or small capacity ink cartridge 230 is attached to the cartridge-attachment section 110 is a state where the ink cartridge 30 or small capacity ink cartridge 230 is inserted to an attached position of the cartridge-attachment section 110. Hereinafter, the posture of the ink cartridge 30 or small capacity ink cartridge 230 in the above use state is referred to as "use posture" or "upright posture".

Note that the upright posture is a posture where the ink cartridge 30 or small capacity ink cartridge 230 is inserted to the cartridge attachment section 110. That is, an ink supply portion 34 or a second ink supply portion 234, described later, faces in a direction crossing the gravitational direction in the upright posture.

Further, in the following description, the frontward direction 51 and the rearward direction 52 may be collectively referred to as a front-rear direction. The upward direction 54 and the downward direction 53 may be collectively referred to as an up-down direction. The rightward direction 55 and the leftward direction 56 may be collectively referred to as a left-right direction.

Note that the directions depth, height, and width in the specification are based on the directions in the upright posture or the use posture of the ink cartridge 30 or small capacity ink cartridge 230, unless otherwise specified. In this specification, "facing frontward" includes facing in a direction including a frontward component, "facing rearward" includes facing in a direction including a rearward component, "facing downward" includes facing in a direction including a downward component, and "facing upward" includes facing in a direction including an upward component. For example, "a front surface faces frontward" denotes that the front surface may face in a frontward direction, or the front surface may face in a direction inclined relative to the frontward direction.

<Outline of Printer 10>

As illustrated in FIG. 1, a printer 10 is an image recording apparatus that records an image by ejecting ink droplets to a paper sheet based on an inkjet recording system and is, for example an inkjet printer. The printer 10 includes a recording head 21, an ink-supplying device 100, and an ink tube 20 connecting the recording head 21 and ink-supplying device 100. The ink-supplying device 100 is provided with a cartridge-attachment section 110. The ink cartridge 30 or small capacity ink cartridge 230 is attached to the cartridge-attachment section 110. The cartridge-attachment section 110 has an opening 112 formed in one surface thereof. The ink cartridge 30 or small capacity ink cartridge 230 is inserted frontward into the cartridge-attachment section 110 through the opening 112, or removed rearward from the cartridge-attachment section 110 through the opening 112.

The ink cartridge 30 or small capacity ink cartridge 230 stores ink. For example, the ink cartridge 30 or small capacity ink cartridge 230 stores ink usable in the printer 10. In a state where attachment of the ink cartridge 30 or small capacity ink cartridge 230 to the cartridge-attachment section 110 is completed, the ink cartridge 30 or small capacity ink cartridge 230 and the recording head 21 are connected to each other by the ink tube 20. The recording head 21 has a damper chamber 28 for temporarily store ink supplied through the ink tube 20. The recording head 21 ejects ink supplied from the damper chamber 28 from a plurality of nozzles 29. Specifically, a drive voltage is selectively applied from a head control board provided in the recording head 21 to a plurality of piezoelectric elements 29A provided corresponding to the plurality of nozzles 29. As a result, ink is ejected selectively from the nozzles 29. That is, the recording head 21 consumes the ink stored in the ink cartridge 30 or the small capacity ink cartridge 230 attached to the cartridge-attachment section 110.

The printer 10 is provided with a sheet tray 15, a feeding roller 23, a conveying roller pair 25, a platen 26, a discharge roller pair 27, and a sheet discharge tray 16. The feeding roller 23 feeds a paper sheet on the sheet tray 15 toward a conveying path 24. The paper sheet fed to the conveying path 24 reaches the conveying roller pair 25. The conveying roller pair 25 then conveys the paper sheet onto the platen 26. The recording head 21 selectively ejects ink onto the paper sheet passing on the platen 26. As a result, an image is recorded on the paper sheet. The paper sheet passing through the platen 26 reaches the discharge roller pair 27. Then, the discharge roller pair 27 discharges the paper sheet to the sheet discharge tray 16 provided at the most downstream side of the conveying path 24.

<Ink Supply Device 100>

As illustrated in FIG. 1, the printer 10 is provided with the ink-supplying device 100. The ink-supplying device 100 supplies ink to the recording head 21. The ink-supplying device 100 includes the cartridge-attachment section 110 that can be attached with the ink cartridge 30 (an example of a liquid cartridge), a tank 103, and an ink tube 20. FIG. 1 illustrates a state where attachment of the ink cartridge 30 to the cartridge-attachment section 110 is completed. That is, in FIG. 1, the ink cartridge 30 is in an attachment state. The posture of the ink cartridge 30 in this state is the use posture.

<Cartridge-Attachment Section 110>

Figure 2:
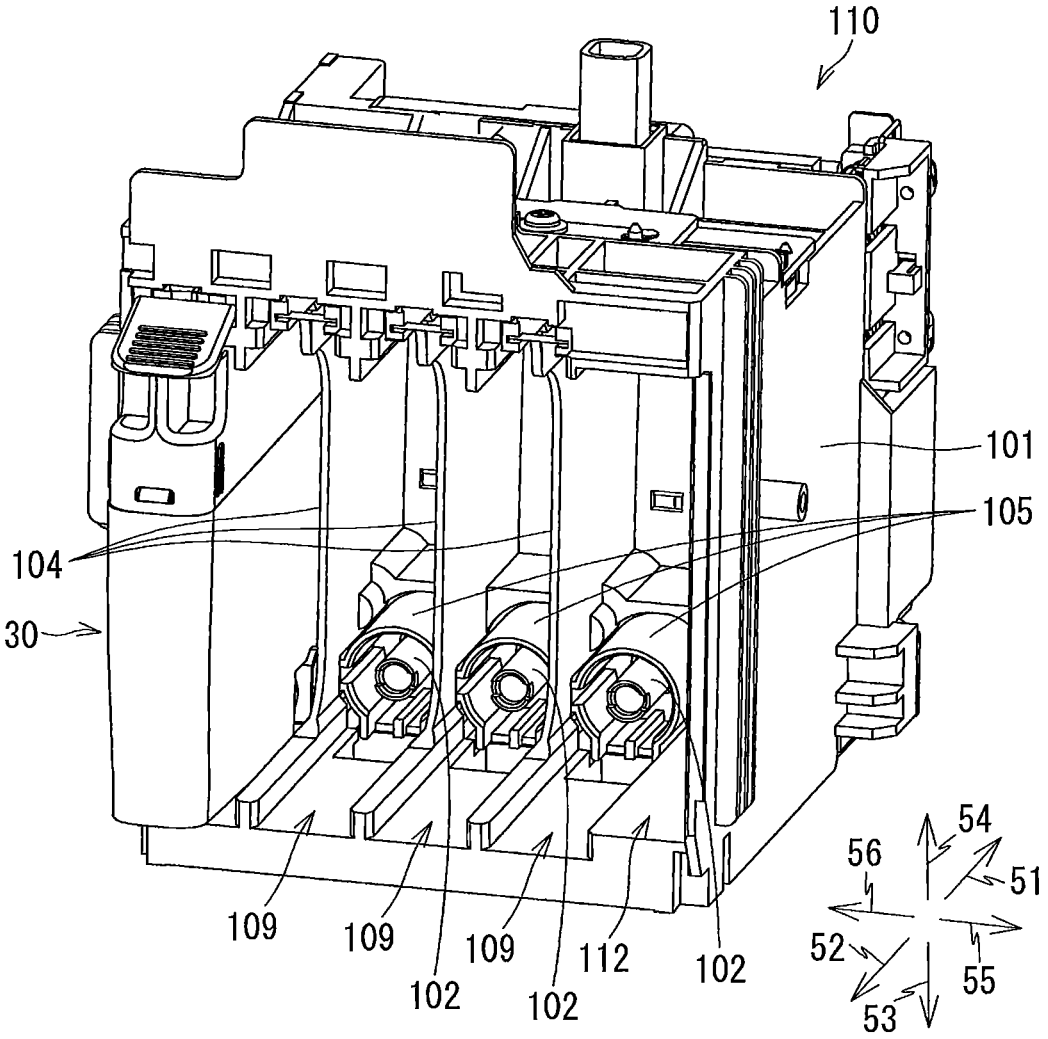
FIG. 2 is a perspective view showing an external appearance of the cartridge-attachment section and an opening of the cartridge-attachment section.
Figure 3:
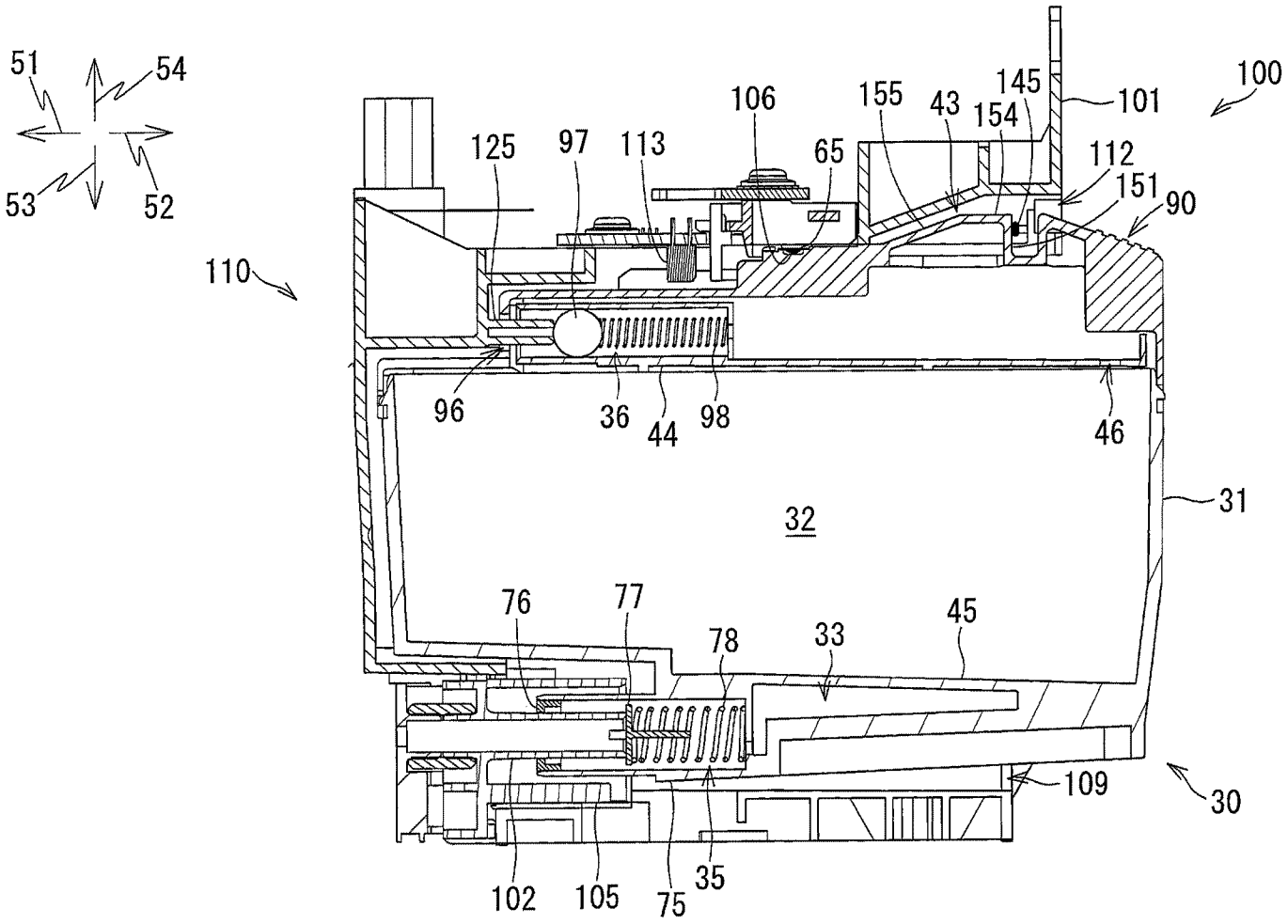
FIG. 3 is a cross-sectional view of the cartridge-attachment section in a state where the ink cartridge according to the embodiment is inserted into the cartridge-attachment section.

As shown in FIGS. 1 through 3, the cartridge-attachment section 110 includes a cartridge case 101, and further includes four sets of an ink needle 102, an optical sensor 113, four contacts 106 are detachably attachable. Here, each set is for each of the four types of ink cartridges, which correspond to the colors of cyan, magenta, yellow and black.

Further, a small capacity ink cartridge 230, described later, is also detachably attachable to the cartridge-attachment section 110.

A set of the four contacts 106 is provided for each of the four insertion spaces 111 of the cartridge case 101. As illustrated in FIG. 3, each of the four sets of the contacts 106 is disposed at the top wall of the cartridge case 101, for each insertion space corresponding to each ink cartridge 30 or small capacity ink cartridge 230. That is, sixteen contacts 106 correspond to each of the ink cartridge 30 or the small capacity ink cartridge 230. Four sets of the tank 103 and ink tube 20 correspond to each of four ink cartridges 30 or small capacity ink cartridge 230, and are disposed in the cartridge case 101. The set of the ink cartridge 30 and the small capacity ink cartridge 230 is an example of a cartridge set. The small capacity ink cartridge 230 is an example of a small amount liquid cartridge.

<Cartridge Case 101>

As illustrated in FIG. 2, the cartridge case 101 forms a housing of the cartridge-attachment section 110. The cartridge case 101 has a box-like shape having a upper surface, a bottom surface, an end surface, and the opening 112. The upper surface defines a top part forming an upper portion of the inner space of the cartridge case 101. The bottom surface defines a bottom part forming a lower portion of the inner space of the cartridge case 101. The end surface connects the top part and bottom part of the inner space of the cartridge case 101. The opening 112 is formed in the cartridge case 101 so as to be opposed to the end surface in the front-rear direction. The opening 112 can be exposed to a user interface surface of the printer 10 which is the surface that a user faces when he or she uses the printer 10.

The ink cartridge 30 or small capacity ink cartridge 230 can be inserted into or removed from the cartridge case 101 through the opening 112. A guide groove 109 is formed in the bottom part of the cartridge case 101. When the lower end portion of the ink cartridge 30 or small capacity ink cartridge 230 is inserted into the guide groove 109, the ink cartridge 30 or small capacity ink cartridge 230 is guided in the frontward and rearward directions 51 and 52 as illustrated in FIG. 2. The cartridge case 101 has three plates 104 partitioning the inner space of the cartridge case 101 into the four vertically long spaces. One ink cartridge 30 or small capacity ink cartridge 230 is housed in each of the spaces partitioned by the three plates 104.

<Ink Needle 102>

As illustrated in FIG. 2, the ink needle 102 has a tubular shape and positioned at the lower portion of the end surface of the cartridge case 101. At the end surface of the cartridge case 101, the ink needle 102 is positioned so as to correspond to an ink supply portion 34 of the ink cartridge 30 or a second ink supply portion 234 of the small capacity ink cartridge 230 attached to the cartridge-attachment section 110. The ink needle 102 protrudes rearward from the end surface of the cartridge case 101.

A guide portion 105 generally having a cylindrical shape is disposed around the ink needle 102 in the cartridge case 101. The guide portion 105 protrudes rearward from the end surface of the cartridge case 101 and has an opening protrusion having an open end. The ink needle 102 is disposed at the center portion of the guide portion 105. The guide portion 105 has a shape into which the ink supply portion 34 of the ink cartridge 30 or second ink supply portion 234 of the small capacity ink cartridge 230 enters inward.

During insertion of the ink cartridge 30 into the cartridge-attachment section 110 in the frontward direction 51, i.e., in a process for the ink cartridge 30 to move to the attached position, the ink supply portion 34 of the ink cartridge 30 enters the corresponding guide portion 105 (refer to FIG. 3). As the ink cartridge 30 is inserted further forward in the frontward direction 51, the ink needle 102 enters an ink supply port 71 of the corresponding ink supply portion 34. The ink needle 102 is thus connected to the corresponding ink supply portion 34 to allow communication with each other. Hence, the ink stored in a second storage chamber 33 formed inside the ink cartridge 30 is allowed to flow into the corresponding tank 103 through an ink valve chamber 35 that is defined in the ink supply portion 34 and an inner space that is defined in the corresponding ink needle 102. Incidentally, the end portion of the ink needle 102 may be flat-shaped tip end or a pointed tip end.

Figure 12:
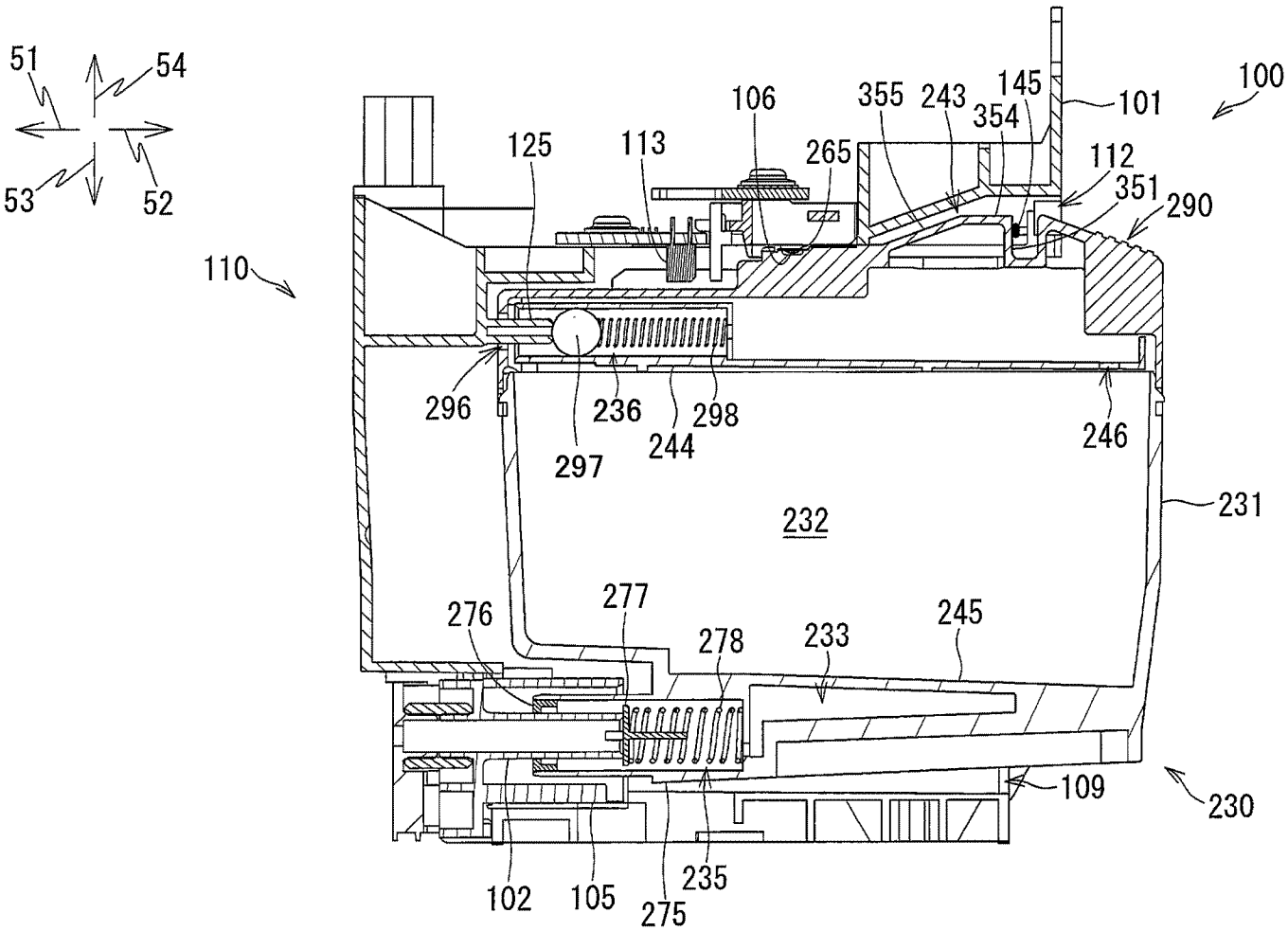
FIG. 12 is a cross-sectional view of the cartridge-attachment section in a state where the small capacity ink cartridge according to the embodiment is inserted into the cartridge-attachment section.

As in the case of the ink cartridge 30, during insertion of the small capacity ink cartridge 230 into the cartridge-attachment section 110 in the frontward direction, i.e., in the process for the small capacity ink cartridge 230 to move to the attached position, the second ink supply portion 234 of the small capacity ink cartridge 230 enters the guide portion 105 (see FIG. 12). When the small capacity ink cartridge 230 is inserted frontward further into the cartridge-attachment section 110, the ink needle 102 is inserted into a second ink supply port 271 formed in the second ink supply portion 234. As a result, the ink needle 102 and second ink supply portion 234 communicate with each other. Then, ink stored in a second small capacity storage chamber 233 formed inside the small capacity ink cartridge 230 is allowed to flow into the corresponding tank 103 through a second ink valve chamber 235 of the second ink supply portion 234 and the inner space of the ink needle 102.

<Contacts 106>

A set of the four contacts 106 is provided for each of the four insertion spaces of the cartridge case 101. Here, the ink cartridges 30 or the small capacity ink cartridge can be inserted into each of the four insertion spaces. As illustrated in FIG. 3, each of the four sets of the contacts 106 is disposed at the top wall of the cartridge case 101, for each insertion space, at a position near the end wall of the cartridge case 101. Each of the four contacts 106 is disposed rearward relative to the corresponding ink needle 102. Each of the four contacts 106 protrude from a lower surface of the top wall downward toward the corresponding insertion space of the cartridge case 101. Although not illustrated in detail in the drawings, the four contacts 106 in each set are arranged to be spaced apart from one another in the left-right direction. The four contacts 106 in each set are arranged at positions respectively corresponding to four electrodes 65 provided at each of the ink cartridges 30 or the four electrodes 265 provided at each of the small capacity ink cartridges 230, as will be described later. Each contact 106 is formed of a material having electrical conductivity and resiliency. The contacts 106 are therefore upwardly resiliently deformable.

In the present embodiment, the four sets of the four contacts 106 are disposed for each set of the four ink cartridges 30. That is, a total of sixteen contacts 106 are provided at the cartridge case 101. However, the number of contacts 106 and the number of electrodes 65 may be arbitrary.

Each contact 106 is electrically connected to a computing unit through an electric circuit. The computing unit includes, e.g., a CPU, a ROM and a RAM and functions as a controller for the printer 10. For example, when the contacts 106 and their corresponding electrodes 65 are brought into contact with each other to be electrically conducted, a voltage Vc is applied to the first electrode 65, the second electrode 65 is grounded, a signal representing data is transmitted to the third electrode 65, and a sync signal is transmitted from the computing unit to the fourth electrode 65. Similarly, when the contacts 106 and their corresponding second electrodes 265 are brought into contact with each other to be electrically conducted, a voltage Vc is applied to the first one of the second electrodes 265, the second one of the second electrodes 265 is grounded, a signal representing data is transmitted to the third one of the second electrodes 265, and a sync signal is transmitted from the computing unit to the fourth one of the second electrodes 265. Electric conduction between the contact 106 and its corresponding electrode 65 allows the computing unit to access data stored in an IC of the ink cartridge 30. Similarly, electric conduction between the contact 106 and its corresponding second electrode 265 allows the computing unit to access data stored in a second IC of the small capacity ink cartridge 230. An output from each contact 106 is inputted to the computing unit through an electric circuit.

<Rod 125>

As illustrated in FIG. 3, a rod 125 is formed on the end surface of the cartridge case 101 at a position upward of the ink needle 102. The rod 125 protrudes rearward from the end surface of the cartridge case 101. The rod 125 has a cylindrical shape. In a state where the ink cartridge 30 is attached to the cartridge-attachment section 110, i.e., in a state where the ink cartridge 30 is located at the attached position, the rod 125 is inserted into an atmosphere communication port 96 (an example of an air communication port of an atmosphere communicating path) to be described later. Similarly, in a state where the small capacity ink cartridge 230 is attached to the cartridge-attachment section 110, i.e., in a state where the small capacity ink cartridge 230 is located at the attached position, the rod 125 is inserted into a second atmosphere communication port 296 (an example of an air communication port) to be described later.

<Optical Sensor 113>

As illustrated in FIG. 3, the optical sensor 113 is disposed on the upper surface of the cartridge case 101. The optical sensor 113 is positioned rearward of the rod 125 and frontward of the four contacts 106. The optical sensor 113 has a light emitter and a light receiver. The light emitter is disposed spaced apart rightward or leftward from the light receiver. A light-blocking plate 67 to be described later of the ink cartridge 30 attached to the cartridge-attachment section 110 is disposed between the light emitter and the light receiver. Further, a second light-blocking plate 267 to be described later of the small capacity ink cartridge 230 attached to the cartridge-attachment section 110 is disposed between the emitter and receiver. In other words, the light emitter and light receiver are disposed opposite to each other, so that the light-blocking plate 67 of the ink cartridge 30 or the second light-blocking plate 267 of the small capacity ink cartridge 230 attached to the cartridge-attachment section 110 is positioned between the light emitter and light receiver.

The optical sensor 113 outputs different detection signals according to whether or not light emitted from the light emitter in the left-right direction is received by the light receiver. For example, the optical sensor 113 outputs a low level signal on the condition that the light outputted from the light emitter cannot be received by the light receiver (that is, a received light intensity is smaller than a predetermined value). On the other hand, the optical sensor 113 outputs a high level signal on the condition that the light output from the light emitter is received by the light receiver (that is, a received light intensity is equal to or larger than a predetermined value).

<Lock Shaft 145>

As illustrated in FIG. 3, a lock shaft 145, as an example of a locked portion, is also provided at the cartridge case 101. The lock shaft 145 extends in the left-right direction at a position near the top wall and the opening 112 of the cartridge case 101. The lock shaft 145 is a rod-like member extending in the left-right direction. For example, the lock shaft 145 is a columnar-shaped metal. The lock shaft 145 has both ends that are fixed to walls defining both ends of the cartridge case 101 in the left-right direction. Accordingly, the lock shaft 145 is not movable (for example, is not pivotable) relative to the cartridge case 101. The lock shaft 145 extends in the left-right direction across the four insertion spaces respectively corresponding to the four ink cartridges 30 or the four small capacity ink cartridges 230. In each of the insertion spaces, a space is provided around the lock shaft 145. Thus, a locking surface 151 (described later) of each ink cartridge 30 or a locking surface 351 of each small capacity ink cartridge 230 can access the lock shaft 145 by moving upward or rearward.

The lock shaft 145 supports the ink cartridge 30 or small capacity ink cartridge 230 attached to the cartridge-attachment section 110 at the attached position. The ink cartridge 30 or small capacity ink cartridge 230 is inserted into the cartridge-attachment section 110 and pivoted to its attached posture, so as to be engaged with the lock shaft 145. Further, the lock shaft 145 holds the ink cartridge 30 in the cartridge-attachment section 110 against the biasing forces of coil springs 78 and 98 of the ink cartridge 30. Here, the coil springs 78 and 98 push rearward the ink cartridge 30 or the small capacity ink cartridge 230. Similarly, the lock shaft 145 holds the small capacity ink cartridge 230 in the cartridge-attachment section 110 against the biasing forces of coil springs 278 and 298 of the small capacity ink cartridge 230, pushing the small capacity ink cartridge 230 rearward.

<Tank 103>

As illustrated in FIG. 1, each tank 103 is provided forward of the cartridge case 101 and is connected to the corresponding ink needle 102. The tank 103 has a box-like shape that allows ink to be stored therein. An atmosphere communication port 124 is formed at an upper portion of each tank 103 so that the tank 103 can be opened to the atmosphere through the atmosphere communication port 124. The tank 103 has an inner space that communicates with the inner space of the ink needle 102. With this structure, ink can flow out from the ink cartridge 30 or the small capacity ink cartridge 230 through the ink needle 102 and is stored in the tank 103. Each tank 103 is also connected to the corresponding ink tube 20. Thus, the ink stored in the inner space of each tank 103 is supplied to the recording head 21 through the corresponding ink tube 20.

<Ink Cartridge 30>

Figure 4:
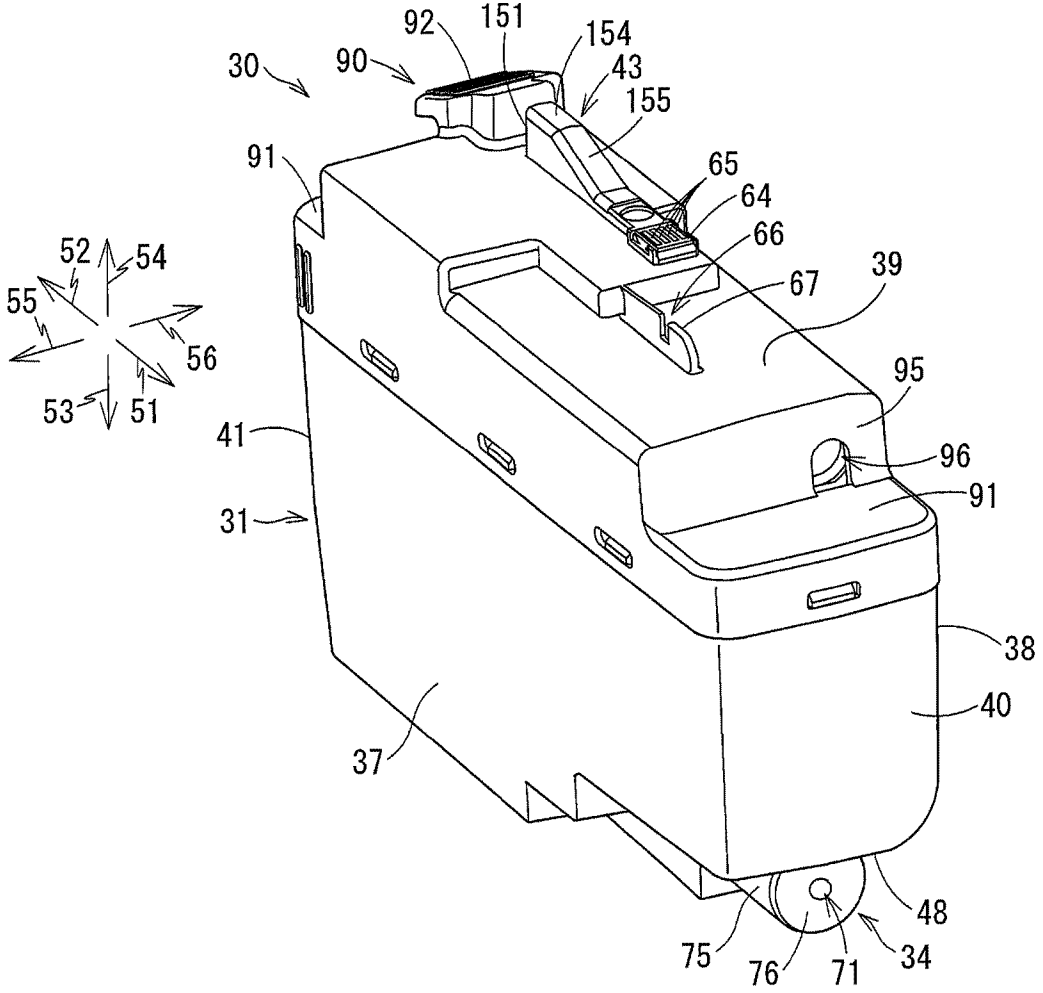
FIG. 4 is a perspective view of the ink cartridge according to the embodiment when viewed from a perspective frontward and upward thereof.
Figure 5:
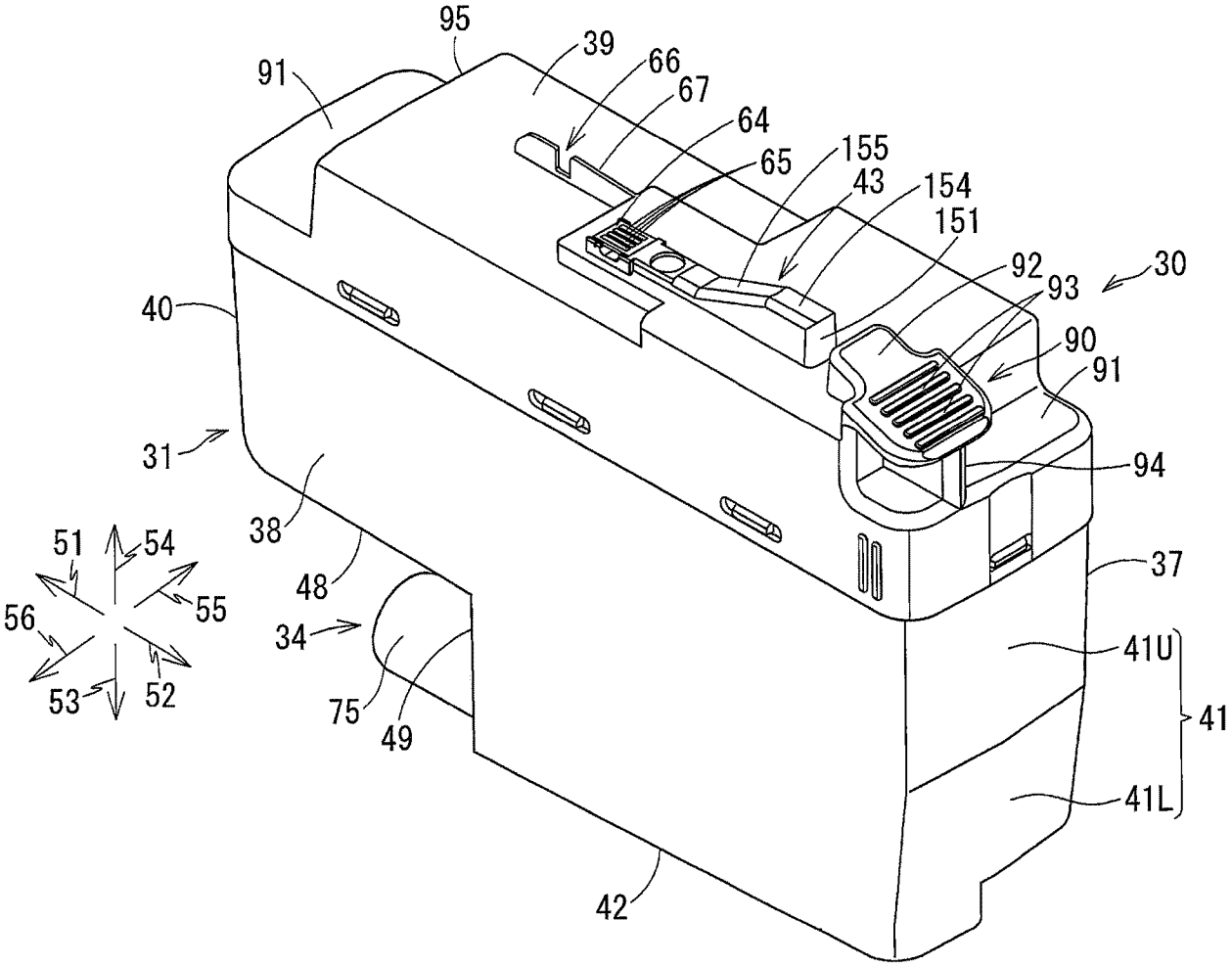
FIG. 5 is a perspective view of the ink cartridge according to the embodiment when viewed from a perspective rearward and upward thereof.
Figure 6B:
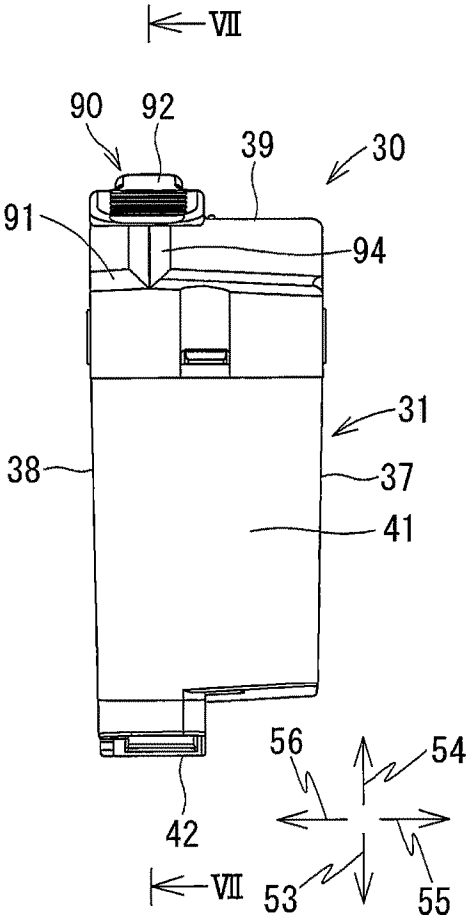
FIG. 6B is a rear side view of the ink cartridge according to the embodiment.

The ink cartridge 30 illustrated in FIGS. 4 to 6 is a container storing ink which is liquid. The ink cartridge 30 illustrated in FIGS. 4 to 6 assumes an posture when it is attached to the cartridge-attachment section 110, i.e., the use posture. As described later, the ink cartridge 30 has a front wall 40, a rear wall 41, an upper wall 39, and a bottom wall 42. In the use posture, a direction from the rear wall 41 to the front wall 40 coincides with the frontward direction 51, a direction from the front wall 40 to the rear wall 41 coincides with the rearward direction 52, a direction from the upper wall 39 to the bottom wall 42 coincides with the downward direction 53, a direction from the bottom wall 42 to the upper wall 39 coincides with the upward direction 54, a direction from a side wall 38 to a side wall 37 coincides with the rightward direction 55, and a direction from the side wall 37 to the side wall 38 coincides with the leftward direction 56. Further, in a state where the ink cartridge 30 is attached to the cartridge-attachment section 110, the outer surface of the front wall 40 faces frontward, the outer surface of the rear wall 41 faces rearward, the outer surface of the bottom wall 42 faces downward, and the outer surface of the upper wall 39 faces upward.

As illustrated in FIGS. 4 to 6, the ink cartridge 30 has a cartridge body 31 of a substantially rectangular parallelepiped shape. A first storage chamber 32 and a second storage chamber 33 are formed inside the cartridge body 31. The cartridge body 31 has a flat shape having a comparatively small width in the left-right dimension. That is, the height in the up-down direction and the depth in the front-rear direction of the cartridge body 31 are larger than the width in the left-right direction. Surfaces of the cartridge body 31 that face frontward and rearward in a state where the ink cartridge 30 is attached to the cartridge-attachment section 110, i.e., in the use posture or the upright posture, are the front wall 40 and rear wall 41, respectively. The front wall 40 and rear wall 41 are positioned away from each other in the front-rear direction. The side walls 37 and 38 extend, crossing the front wall 40 and rear wall 41, to connect the front and rear walls 40 and 41. In the use posture or the upright posture, the outer surface of the side wall 37 faces rightward, and the outer surface of the side wall 38 faces leftward. In the cartridge body 31, at least the rear wall 41 has translucency allowing the liquid surface of ink stored in the first and second storage chambers 32 and 33 to be visible from outside.

As illustrated in FIG. 5, the rear wall 41 has an upper portion 41U and a lower portion 41L. The upper portion 41U is positioned upward of the lower portion 41L. A part of the lower portion of the lower portion 41L is positioned frontward of the upper portion 41U. The upper and lower parts 41U and 41L are flat surfaces and cross each other, not orthogonally. The lower portion 41L is inclined relative to the up-down direction so as to be closer to the front wall 40 as it approaches the bottom wall 42.

Figure 6A:
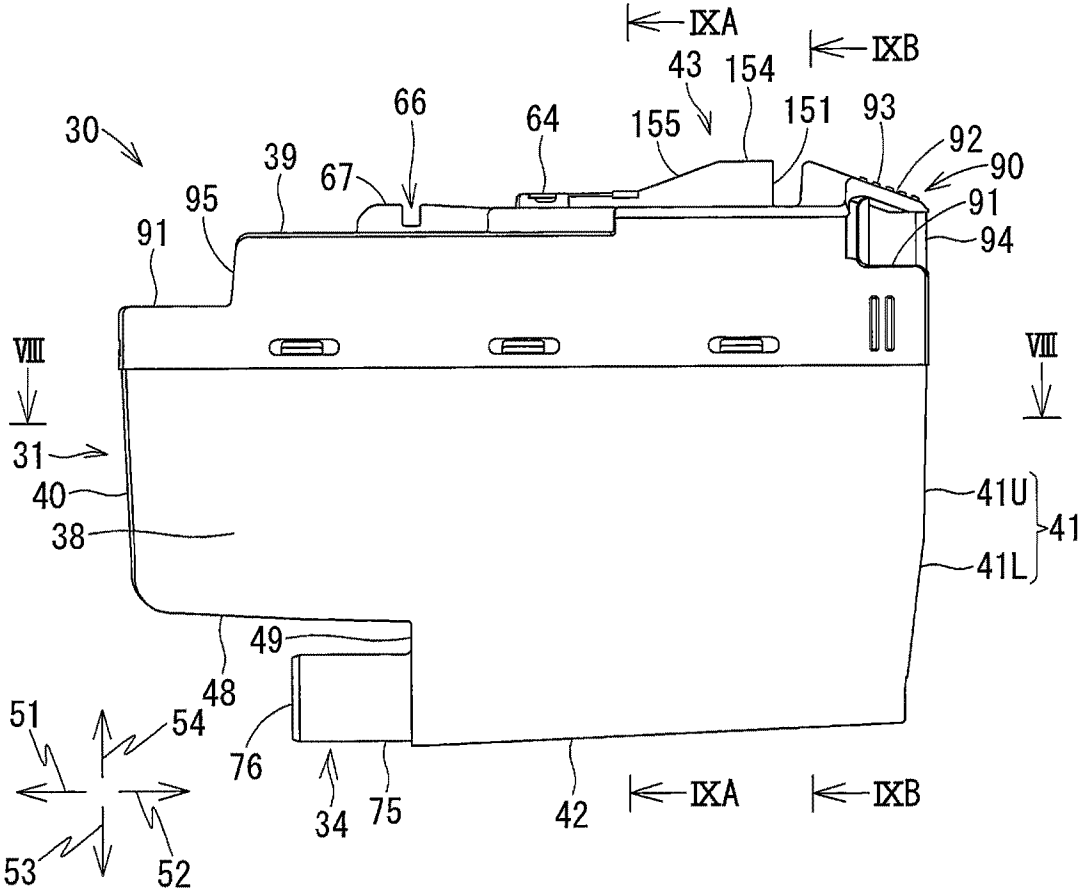
FIG. 6A is a left side view of the ink cartridge according to the embodiment.

As illustrated in FIG. 6A, the bottom wall 42 is inclined relative to the front-rear direction such that the front end portion is positioned downward of the rear end portion. The front end portion of the bottom wall 42 is positioned frontward of a locking surface 151 to be described later. The rear end portion of the bottom wall 42 is connected to the lower end portion of the lower portion 41L of the rear wall 41. The bottom wall 42 connects a sub-front wall 49 (specifically, the lower portion of the sub-front wall 49 and, more specifically, the lower end portion of the sub-front wall 49) and rear wall 41.

As illustrated in FIG. 6A, the cartridge body 31 has a sub bottom wall 48 which is positioned upward of the bottom wall 42 and extends rearward continuously connected to the lower end portion of the front wall 40. The rear end portion of the sub bottom wall 48 is positioned rearward of the front end portion of the ink supply portion 34. Both of the bottom wall 42 and sub bottom wall 48 are connected to the sub-front wall 49. The sub-front wall 49 extends upward from the front end portion of the bottom wall 42 and downward from the rear end portion of the sub bottom wall 48. The ink supply portion 34 extends frontward from the sub-front wall 49 at a position downward of the sub bottom wall 48 and upward of the bottom wall 42. Each of the side walls 37 and 38 extends in the front-rear direction and up-down direction, and connects the front wall 40, sub bottom wall 48, sub-front wall 49, bottom wall 42, and rear wall 41.

As illustrated in FIGS. 4 to 6, a protrusion 43 is provided on the upper wall 39 of the cartridge body 31. The protrusion 43 extends in the front-rear direction at a position offset leftward from the center of the upper wall 39 in the left-right direction. A surface that faces rearward and downward at the rear end portion of the protrusion 43 is the locking surface 151. The locking surface 151 is positioned upward of the upper surface 39 of the cartridge body 31. The locking surface 151 extends in the up-down direction. In a state where the ink cartridge 30 is set in the cartridge-attachment section 110, the locking surface 151 and the lock shaft 145 contact each other in the front-rear direction. The contact between the locking surface 151 and the lock shaft 145 in the front-rear direction allows the ink cartridge 30 to be held at the cartridge-attachment section 110 against the biasing force of the coil spring 78. In a state where the ink cartridge 30 is held the cartridge-attachment section 110, the ink cartridge 30 is restricted to move in the rear direction 52, i.e., the attachment state. The locking surface 151 is an example of an access portion or second access portion.

In the protrusion 43, a horizontal surface 154 is provided frontward of the locking surface 151, and is continuously connected to the locking surface 151. The horizontal surface 154 extends in the left-right direction and front-rear direction. An inclined surface 155 is positioned frontward of the horizontal surface 154 so as to be continuously connected to the horizontal surface 154. The inclined surface 155 faces upward and frontward. The inclined surface 155 is inclined such that the front end portion thereof is positioned downward of the rear end portion thereof. The locking surface 151 and inclined surface 155 are continuously connected to each other through the horizontal surface 154, so that a boundary edge between the locking surface 151 and the inclined surface 155 does not constitute a ridge-like shape. In the process of insertion of the ink cartridge 30 by way of the inclined surface 155 and horizontal surface 154 into the cartridge-attachment section 110, the lock shaft 145 is smoothly guided to the rear side of the locking surface 151 while abutting against the inclined surface 155 and horizontal surface 154.

An operation portion 90 is formed on the upper wall 39 of the cartridge body 31 at a position rearward of the locking surface 151. Sub-upper surfaces 91 (front-side sub-upper surface and rear-side sub-upper surface) are formed frontward of and rearward of the upper wall 39 of the cartridge body 31, respectively, so as to be positioned downward of the outer surface positioned at the center portion of the upper wall 39 in the front-rear direction. The operation portion 90 is disposed upward of the rear-side sub-upper surface 91 with a space therebetween. The operation portion 90 has a plate-like shape and protrudes upward from the boundary between the upper wall 39 and the rear-side sub-upper surface 91 to the same level as the protrusion 43. The upper end portion of the operation portion 90 is positioned frontward of the lower end portion thereof. A rib 94 is formed between the operation portion 90 and rear-side sub-upper surface 91 so as to continue from the operation portion 90 and the rear-side sub-upper surface 91 and extend rearward. The dimension of the rib 94 in the left-right direction is smaller than those of the operation portion 90 and rear-side sub-upper surface 91 in the left-right direction. The rear side of the operation portion 90 is suppressed from being deformed in the up-down direction by the rib 94.

A surface of the operation portion 90 that faces upward and rearward is an operation surface 92. The rear side of the operation surface 92 and the rear-side of the sub-upper surface 91 extend in the front-rear direction, and these positions overlap each other in the front-rear direction when viewed in the vertical direction. In other words, when the ink cartridge 30 is viewed downward from the upper side thereof, the rear side of the operation surface 92 and rear-side sub-upper surface 91 overlap each other. In the operation surface 92, a plurality of projections, e.g., a plurality of ridges 93 extending in the left-right direction are formed spaced apart from one another in the front-rear direction. Disposition of the ridges 93 allows the user to easily visually recognize the operation surface 92 and prevents the user's finger from slipping on the operation surface 92 when the user operates the operation surface 92 with his or her finger.

The operation surface 92 can be visible when the ink cartridge 30 is viewed downward from the upper side thereof and frontward from the rear side thereof. The operation surface 92 is a surface for the user to operate to remove the ink cartridge 30 from the cartridge-attachment section 110. The operation portion 90 and the cartridge body 31 are integrally formed. Thus, the operation portion 90 is fixed to the cartridge body 31 and is thus not moved (pivoted, for example.) relative to the cartridge body 31. Thus, force applied from the user to the operation surface 92 is directly transmitted to the cartridge body 31 without changing the direction.

The outer surfaces of the respective front wall 40, rear wall 41, upper wall 39, bottom wall 42, and side walls 37, 38 of the ink cartridge 30 need not necessarily constitute one plane. That is, surfaces that can be visually recognized when the ink cartridge 30 assuming the attached posture is viewed rearward from the front side thereof and positioned frontward of the center of the ink cartridge 30 in the attached posture in the front-rear direction is the outer surface of the front wall 40. Surfaces that can be visually recognized when the ink cartridge 30 in the attached posture or the upright posture is viewed frontward from the rear side thereof and positioned rearward of the front-rear center portion of the ink cartridge 30 are the outer surfaces of the rear wall 41. Surfaces that can be visually recognized when the ink cartridge 30 in the attached posture or the upright posture is viewed downward from the upper side thereof and positioned upward of the up-down center portion of the ink cartridge 30 are the outer surfaces of the upper wall 39. Surfaces that can be visually recognized when the ink cartridge 30 in the attached posture or the upright posture is viewed upward from the lower side thereof and positioned downward of the up-down center portion of the ink cartridge 30 are the outer surfaces of the bottom wall 42. The same can be said for the outer surfaces of the respective side walls 37 and 38.

As illustrated in FIGS. 4 to 6, the light-blocking plate 67 protrudes upward from the outer surface of the upper wall 39. The light-blocking plate 67 extends in the front-rear direction. The light-blocking plate 67 is positioned frontward of the protrusion 43. The light-blocking plate 67 is positioned frontward of an IC board 64 to be described later.

The light-blocking plate 67 shields the light of the optical sensor 113 that travels in the left-right direction. More specifically, when the light emitted or irradiated from the light emitter of the optical sensor 113 hits the light-blocking plate 67 before it reaches the light receiver, the intensity of the light that reaches the light receiver is reduced to less than a predetermined intensity, e.g., zero. The light-blocking plate 67 may completely shield light traveling in the left-right direction, may partially attenuate light, may bend the traveling direction of light, or may totally reflect light. A cutout 66 is formed in the light-blocking plate 67. The cutout 66 is a space recessed downward from the upper end portion of the light-blocking plate 67 and extends in the front-rear direction. The cutout 66 is positioned corresponding to the optical sensor 113, so that light emitted from the light emitter of the optical sensor 113 is not shielded before it reaches the light receiver. The type of the ink cartridge 30, i.e., the type of or the initial amount of the ink stored in the ink cartridge 30 can be determined by the user of the printer 10 or the printer 10 depending on the presence or absence of the cutout 66. The light-blocking plate 67 is an example of an access portion or second access portion.

As illustrated in FIGS. 4 to 6, the IC board 64 is provided on the outer surface of the upper wall 39 and between the light-blocking plate 67 and the protrusion 43. The IC board 64 is electrically connected to the four contacts 106 in a process that the ink cartridge 30 is attached to the cartridge-attachment section 110 and in a state where the ink cartridge 30 is attached to the cartridge-attachment section 110.

The IC board 64 has a substrate, an IC (not illustrated), and four electrodes 65. The substrate supports the IC. The four electrodes 65 are formed on the substrate. The four electrodes 65 and the IC are electrically connected to each other. Each of the four electrodes 65 extends in the front-rear direction, and is arranged in the left-right direction. The four electrodes 65 are exposed to the upper surface of the IC board 64 so as to be electrically accessible. This allows each of the four contacts 106 of the cartridge case 101 and each of the four electrodes 65 to be brought into direct contact with each other. The IC is an integrated circuit and readably stores data indicating information concerning the ink cartridge 30, including, e.g., a lot number, a manufacturing date, and an ink color. The substrate may be a so-called rigid substrate, or a flexible substrate having flexibility. The IC board 64 is an example of an access portion or second access portion.

A stepped surface 95 extends upward from the rear end portion of the front-side sub-upper surface 91. The stepped surface 95 faces frontward. An atmosphere communication port 96 is formed in the stepped surface 95. In the process of attachment of the ink cartridge 30 to the cartridge-attachment section 110, the rod 125 enters the atmosphere communication port 96. The rod 125 entering the atmosphere communication port 96 moves a valve 97 backward that seals the atmosphere communication port 96 against the biasing force of the coil spring 98. Then, the valve 97 moved backward is separated from the atmosphere communication port 96, whereby the first storage chamber 32 is opened to the atmosphere.

<Internal Configuration of Housing 31>

Figure 7:
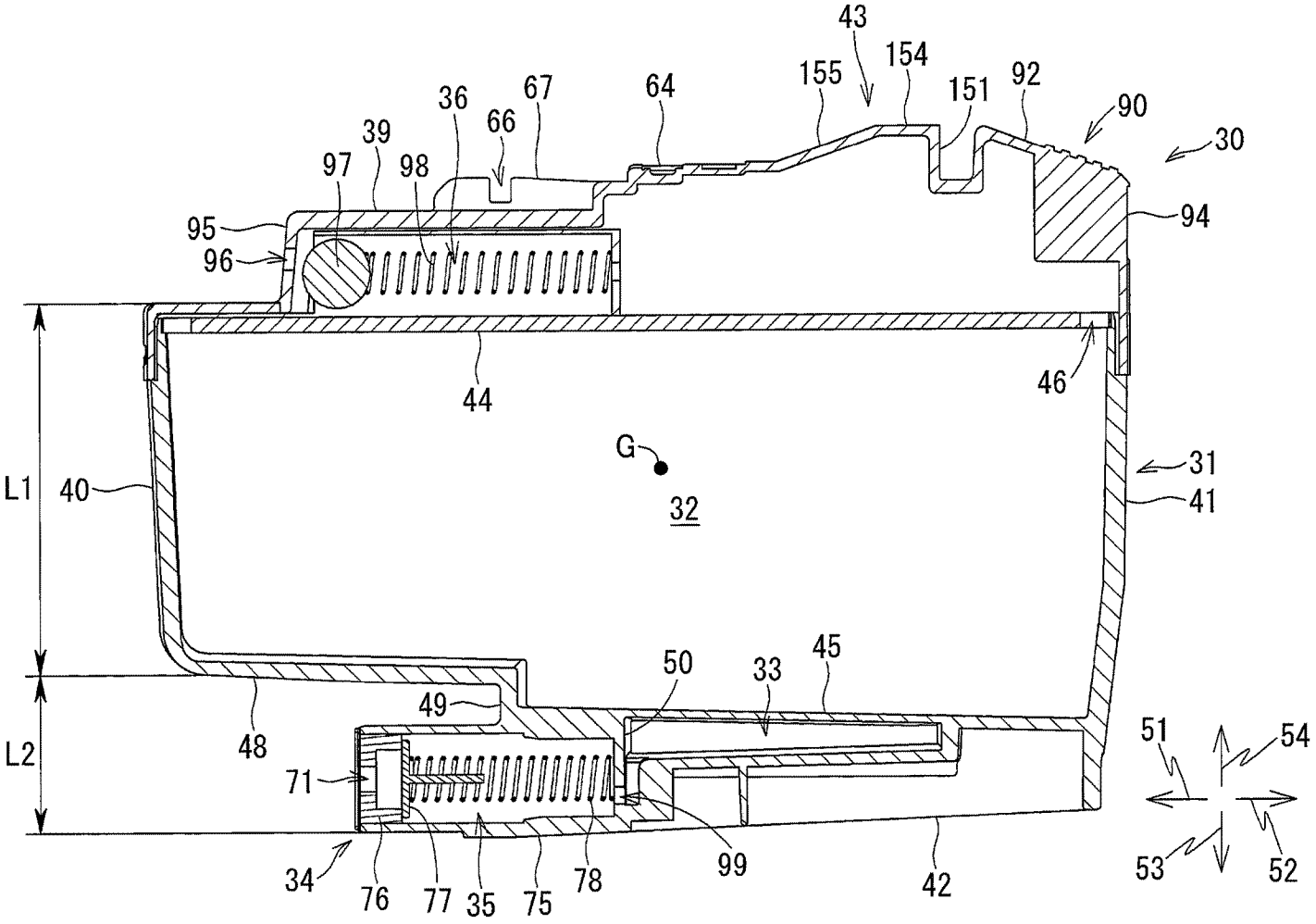
FIG. 7 is a cross-sectional view of the ink cartridge according to the embodiment taken along a line VII-VII illustrated in FIG. 6B.

As illustrated in FIG. 7, the first storage chamber 32, second storage chamber 33, an ink valve chamber 35, and an atmospheric valve chamber 36 are formed inside the cartridge body 31. Further, the cartridge body 31 has inside thereof a partitioning wall 44, and a partitioning wall 45. The partitioning wall 44 separates the first storage chamber 32 and atmospheric valve chamber 36. The partitioning wall 45 separates the first and second storage chambers 32 and 33. Each of the partitioning walls 44 and 45 extends in the front-rear direction and left-right direction. The partitioning walls 44 and 45 are disposed opposite to each other in the up-down direction. The partitioning wall 44 crosses the sub-front wall 49.

The upper end portion of the first storage chamber 32 is defined by the lower surface of the partitioning wall 44, and the lower end portion of the first storage chamber 32 is defined by the inner surface of the sub bottom wall 48 and the upper surface of the partitioning wall 45. The front end portion of the first storage chamber 32 is defined by the inner surface of the front wall 40, and the rear end portion of the first storage chamber 32 is defined by the inner surface of the rear wall 41. Both the side ends of the first storage chamber 32 are defined by the inner surfaces of the respective side walls 37 and 38. That is, the first storage chamber 32 is a space defined by the lower surface of the partitioning wall 44, inner surface of the sub bottom wall 48, upper surface of the partitioning wall 45, inner surface of the front wall 40, inner surface of the rear wall 41, and inner surfaces of the side walls 37 and 38. At the time of manufacturing of the ink cartridge 30, ink stored in the first storage chamber 32 contacts the inner surface of the sub bottom wall 48, upper surface of the partitioning wall 45, inner surface of the front wall 40, inner surface of the rear wall 41, and inner surfaces of the side walls 37 and 38. A through hole 46 is formed in the partitioning wall 44. The first storage chamber 32 and atmospheric valve chamber 36 are in communication with each other through the through hole 46.

In the inner space of the cartridge body 31, the second storage chamber 33 stores ink, and is positioned downward of the first storage chamber 32 in the use posture. The capacity of the second storage chamber 33 for storing ink is smaller than that of the first storage chamber 32. The second storage chamber 33 is positioned between the inner surface of the sub-front wall 49, the inner surface of the rear wall 41, and the lower surface of the partitioning wall 45.

The upper end portion of the second storage chamber 33 is defined by the lower surface of the partitioning wall 45 and the lower end portion thereof by the upper surface of the bottom wall 42. The rear end portion of the second storage chamber 33 is defined by the inner surface of the rear wall 41. Both the side ends of the second storage chamber 33 are defined by the inner surfaces of the side walls 37 and 38. A partition wall 50 is formed between the second storage chamber 33 and the ink valve chamber 35. The front end portion of the second storage chamber 33 is defined by a part of the surface of the partition wall 50 that is close to the second storage chamber 33. That is, the second storage chamber 33 is a space defined by the lower surface of the partitioning wall 45, upper surface of the bottom wall 42, inner surface of the rear wall 41, inner surfaces of the respective side walls 37 and 38, and a part of the surface of the partition wall 50 that is close to the second storage chamber 33. The second storage chamber 33 is in communication with the first storage chamber 32 through a communication port 47 formed in the partitioning wall 45. The second storage chamber 33 is in communication with the ink valve chamber 35 through a through hole 99 formed in the partition wall 50. The communication port 47 is an example of a communication opening.

The valve 97 and coil spring 98 are housed in the atmospheric valve chamber 36. The atmospheric valve chamber 36 communicates with the atmosphere through the atmosphere communication port 96 formed in the stepped surface 95. The valve 97 is movable between a closing position where the valve 97 seals the atmosphere communication port 96 and an opening position where the valve 97 is separated from the atmosphere communication port 96. The coil spring 98 is disposed so as to be expandable or contractible in the front-rear direction and biases the valve 97 in a direction in which the valve 97 abuts against the atmosphere communication port 96, i.e., in the frontward direction 51.

The ink supply portion 34 (an example of a liquid supply portion) has a cylindrical outer shape. More specifically, the ink supply portion 34 has a packing 76 and a cylinder 75 that has an open front end portion. The cylinder 75 is disposed downward of the sub bottom wall 48 and protrudes frontward from the sub-front wall 49. The inner space of the cylinder 75 serves as the ink valve chamber 35. The front end portion of the cylinder 75 has an opening opened to the outside of the ink cartridge 30. The packing 76 is positioned at the front end portion of the cylinder 75.

A valve 77 and a coil spring 78 are housed in the ink valve chamber 35. The valve 77 is moved in the front-rear direction to open and close the ink supply port 71 penetrating the center of the packing 76. The coil spring 78 biases the valve 77 forward. Accordingly, in a state where external force is not applied, the valve 77 closes the ink supply port 71 of the packing 76.

The packing 76 is a disk-shaped member having a through hole at the center portion thereof. The packing 76 is made from an elastic material such as rubber or elastomer. A tubular inner peripheral surface is formed so as to penetrate the center portion of the packing 76 in the front-rear direction. By the tubular inner peripheral surface, the ink supply port 71 is formed. The inner diameter of the ink supply port 71 is slightly smaller than the outer diameter of the ink needle 102.

When the ink cartridge 30 is inserted into the cartridge-attachment section 110 in a state where the valve 77 closes the ink supply port 71, the ink needle 102 enters the ink supply port 71. The ink needle 102 elastically deforms the packing 76, and the outer peripheral surface thereof liquid-tightly contacts the inner peripheral surface, which defines the ink supply port 71. When the leading end portion of the ink needle 102 passes through the ink supply port 71 formed in the packing 76 and enters the ink valve chamber 35, it abuts against the valve 77. When the ink cartridge 30 is further inserted into the cartridge-attachment section 110, the ink needle 102 moves the valve 77 rearward against the biasing force of the coil spring 78. This allows ink stored in the valve chamber 35 to flow into the inner space of the ink needle 102.

<Communication Port 47>

Figure 8A:
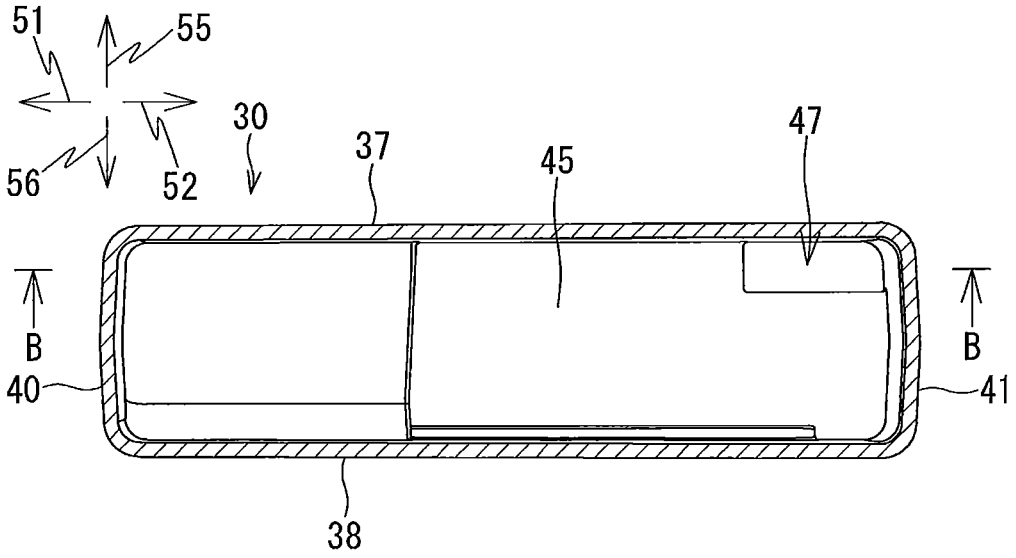
FIG. 8A is a cross-sectional view of the ink cartridge according to the embodiment taken along a line VIII-VIII illustrated in FIG. 6A.
Figure 8B:
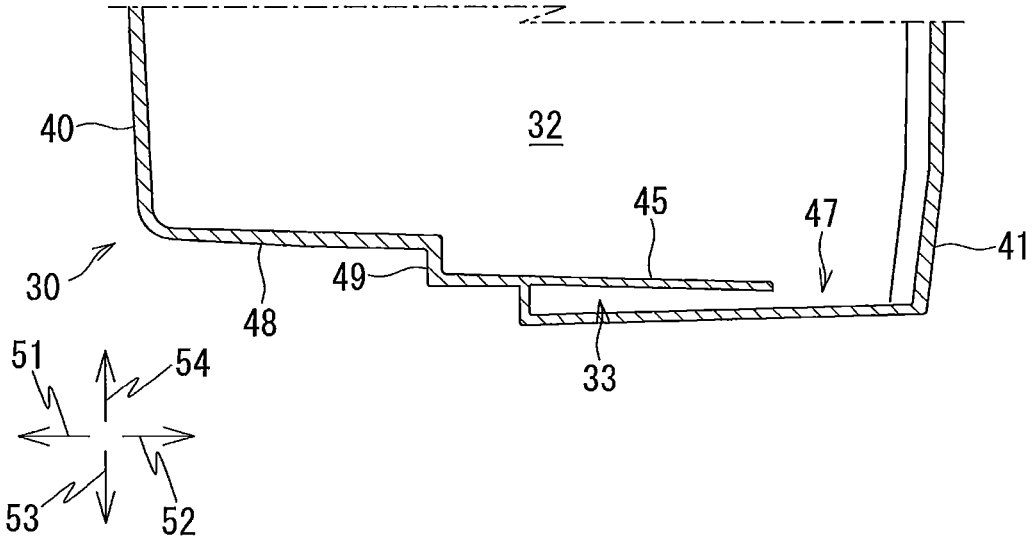
FIG. 8B is a cross-sectional view of the ink cartridge according to the embodiment taken along a line B-B illustrated in FIG. 8A.

As illustrated in FIGS. 8A and 8B, the communication port 47 is formed in the partitioning wall 45. The first storage chamber 32 and the second storage chamber 33 are in communication with each other via the communication port 47 such that ink can flow therebetween. As illustrated in FIG. 8A, in the use posture of the ink cartridge 30, the communication port 47 is disposed adjacent to the end portion in the left-right direction of the inner surface of the rear wall 41 in the cartridge body 31. The communication port 47 is defined by the inner surface of the rear wall 41, inner surface of the side wall 37, and the end surface of the partitioning wall 45. The end surface of the partitioning wall 45 connects the upper and lower surfaces thereof. The upper end portion of the communication port 47 is formed by the upper surface of the partitioning wall 45 and inner surface of the rear wall 41.

Figure 9B:
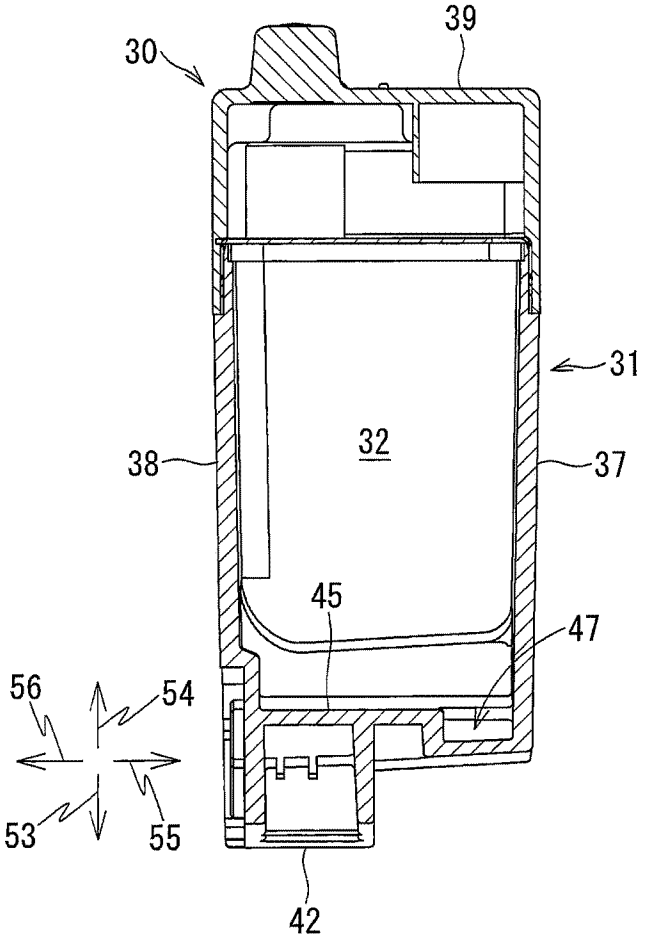
FIG. 9B is a cross-sectional view of the ink cartridge according to the embodiment taken along a line IXB-IXB illustrated in FIG. 6A.
Figure 9A:
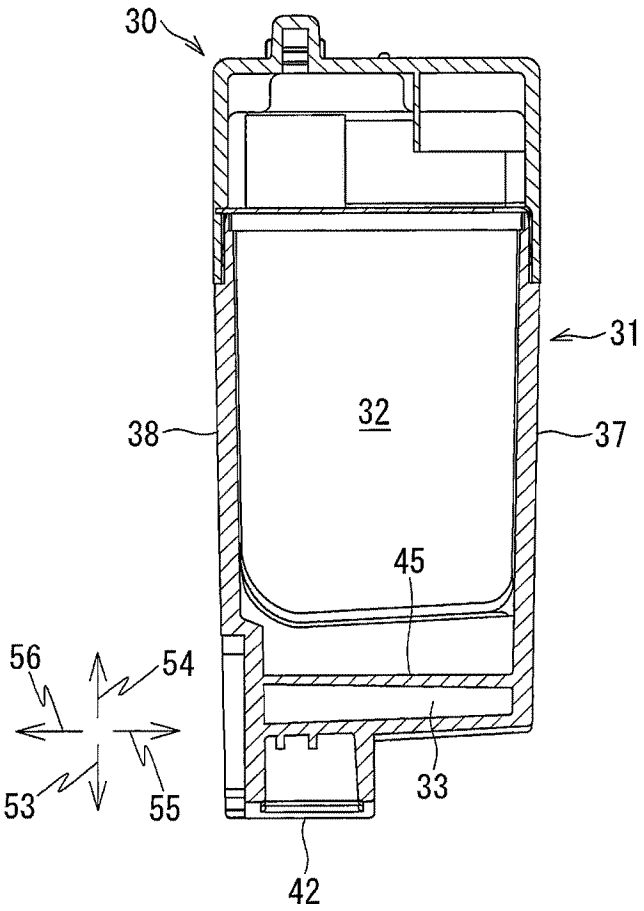
FIG. 9A is a cross-sectional view of the ink cartridge according to the embodiment taken along a line IXA-IXA illustrated in FIG. 6A.

As illustrated in FIGS. 9A and 9B, in the use posture, the upper surface of the partitioning wall 45 is inclined downward toward the communication port 47 in the left-right direction. That is, in FIG. 9B, the right end portion of the upper surface of the partitioning wall 45 is positioned downward of the left end thereof. Further, as illustrated in FIG. 8B, in the use posture, the upper surface of the partitioning wall 45 is inclined downward toward the communication port 47 in the front-rear direction. That is, in FIG. 8B, the front end portion of the upper surface of the partitioning wall 45 is positioned upward of the rear end portion thereof. Further, as illustrated in FIG. 8B, the inner surface of the sub bottom wall 48 is inclined such that the rear end portion thereof is downward of the front end portion thereof.

<Arrangement of Parts in Ink Cartridge 30>

As illustrated in FIG. 7, a length L1 of the front wall 40 in the up-down direction is larger than a length L2 of the sub-front wall 49 in the up-down direction (L1>L2). The front wall 40 is positioned frontward of the ink supply port 71 in the front-rear direction. The ink supply port 71 is disposed at a position overlapping the sub bottom wall 48 when viewed in the vertical direction and positioned downward of the sub bottom wall 48. That is, the ink supply port 71 and the sub bottom wall 48 are arrayed in the up-down direction. Further, the front wall 40 is positioned frontward of the atmosphere communication port 96 in the front-rear direction. The light-blocking plate 67, IC board 64, and locking surface 151 are positioned rearward of the atmosphere communication port 96 in the front-rear direction.

<Small Capacity Ink Cartridge 230>

Figure 10:
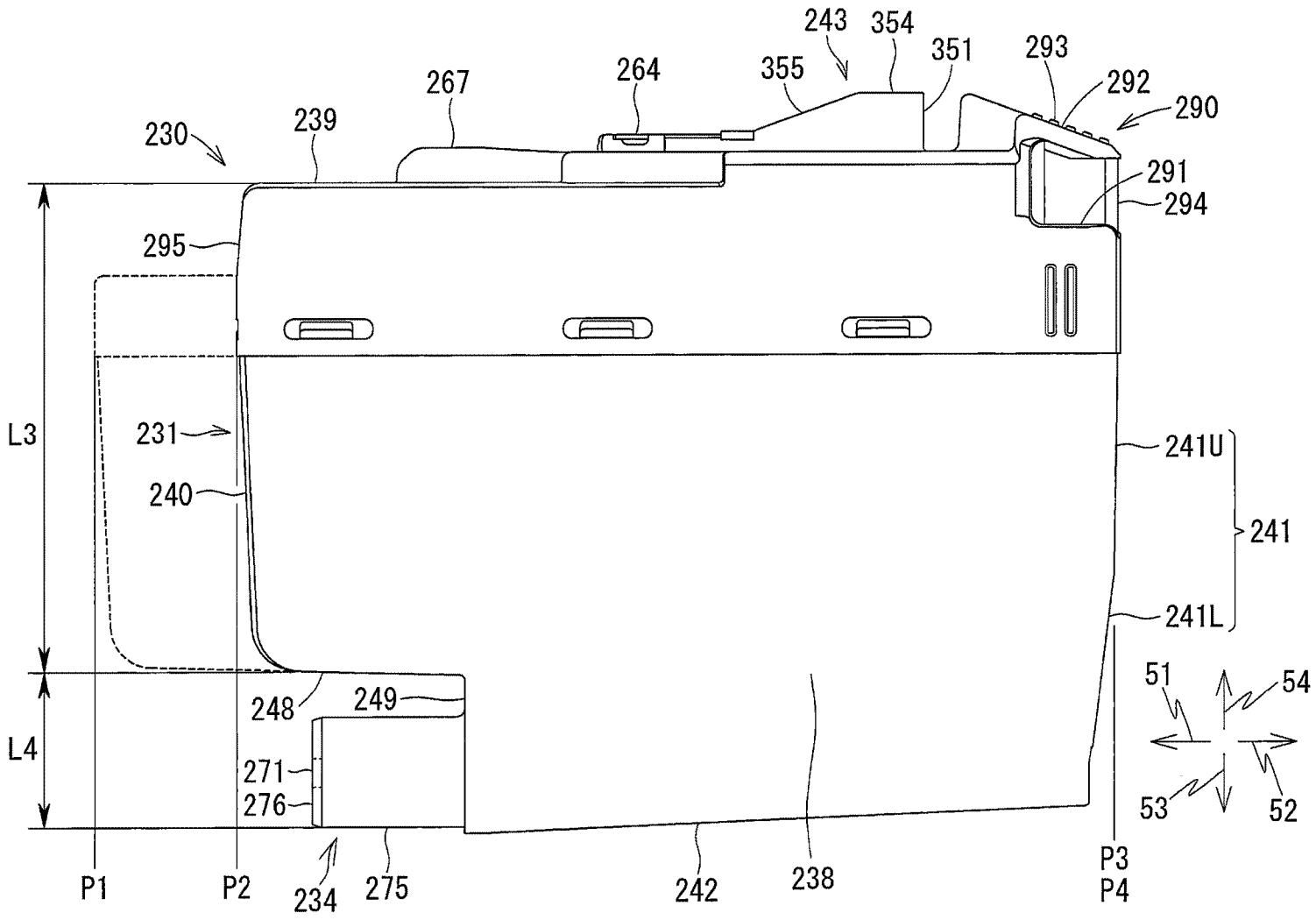
FIG. 10 is a left side view of a small capacity ink cartridge according to the embodiment.
Figure 11:
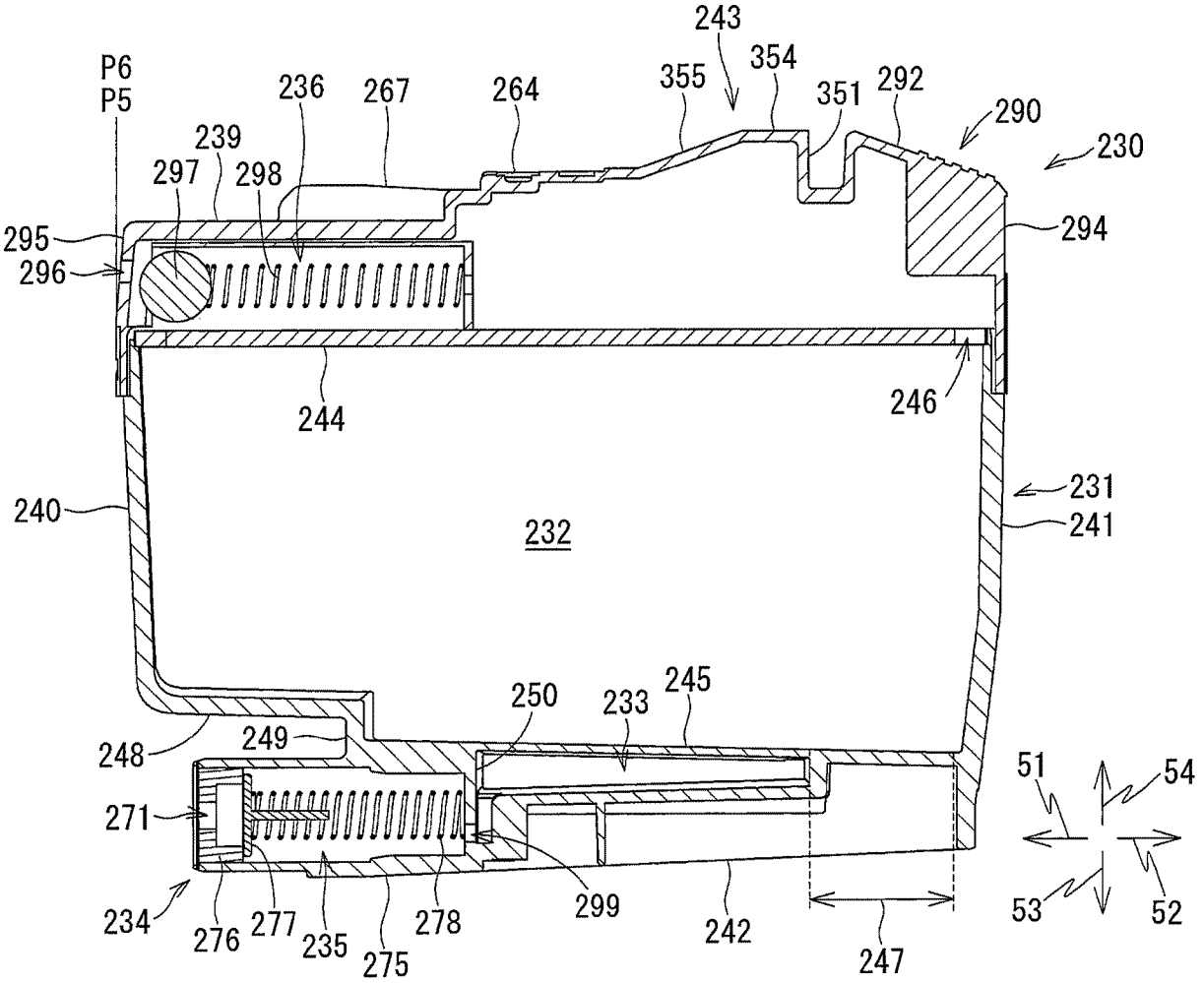
FIG. 11 is a cross-sectional view of the small capacity ink cartridge according to the embodiment viewed from a left side thereof.

The small capacity ink cartridge 230 illustrated in FIGS. 10 and 11 is a container storing ink which is liquid. The small capacity ink cartridge 230 illustrated in FIGS. 10 and 11 is in a posture when it is attached to the cartridge-attachment section 110, i.e., the use posture or the upright posture. As described later, the small capacity ink cartridge 230 has a second front wall 240, a second rear wall 241, a second upper wall 239, and a second bottom wall 242. In the use posture, a direction from the second rear wall 241 to the second front wall 240 coincides with the frontward direction 51, a direction from the second front wall 240 to the second rear wall 241 coincides with the rearward direction 52, a direction from the second upper wall 239 to the second bottom wall 242 coincides with the downward direction 53, a direction from the second bottom wall 242 to the second upper wall 239 coincides with the upward direction 54, and a direction from a second side wall 238 to a second side wall 237 coincides with the rightward direction 55, and a direction from the second side wall 237 to the second side wall 238 coincides with the leftward direction 56. Further, in a state where the ink cartridge 30 is attached to the cartridge-attachment section 110, the outer surface of the second front wall 240 faces frontward, the outer surface of the second rear wall 241 faces rearward, the outer surface of the second bottom wall 242 faces downward, and the outer surface of the second upper wall 239 faces upward.

As illustrated in FIGS. 10 and 11, the small capacity ink cartridge 230 has a second cartridge body 231 of a substantially rectangular parallelepiped shape. A first small capacity storage chamber 232 and a second small capacity storage chamber 233 are formed inside the second cartridge body 231. The second cartridge body 231 has a flat shape as a whole which is comparatively small in the left-right direction. That is, the height of the second cartridge body 231 in the up-down direction and the depth in the front-rear direction are larger than the width in the left-right direction. Surfaces of the second cartridge body 231 that face frontward and rearward in a state where the small capacity ink cartridge 230 is inserted into the cartridge-attachment section 110, i.e., in the use posture are the second front wall 240 and the second rear wall 241, respectively. The second front wall 240 and second rear wall 241 are spaced away from each other in the front-rear direction. The second side walls 237 and 238 extend, crossing the second front wall 240 and second rear wall 241, so that each of the second side walls 237 and 238 connects the second front and second rear walls 240 and 241. In the use posture, the outer surface of the second side wall 237 faces rightward, and the outer surface of the second side wall 238 faces leftward. In the second cartridge body 231, at least the second rear wall 241 has translucency allowing the liquid surface of ink stored in the first and second small capacity storage chambers 232 and 233 to be visible from outside. In FIG. 10, the position of the front wall 40 of the ink cartridge 30 is denoted by the dashed line.

As illustrated in FIG. 10, the second rear wall 241 has an upper portion 241U and a lower portion 241L. The upper portion 241U is positioned upward of the lower portion 241L. A part of the lower portion of the lower portion 241L is positioned frontward of the upper portion 241U. The upper and lower parts 241U and 241L are flat surfaces and cross each other not orthogonally. The lower portion 241L is inclined relative to the up-down direction so as to be closer to the second front wall 240 as it approaches the second bottom wall 242.

As illustrated in FIG. 10, the second bottom wall 242 is inclined relative to the front-rear direction such that the front end portion is positioned downward of the rear end portion. The front end portion of the second bottom wall 242 is positioned frontward of a second locking surface 351 to be described later. The rear end portion of the second bottom wall 242 is connected to the lower end portion of the lower portion 241L of the second rear wall 241. The second bottom wall 242 connects a second sub-front wall 249 (specifically, the lower portion of the second sub-front wall 249 and, more specifically, the lower end portion of the second sub-front wall 249) and the second rear wall 241.

As illustrated in FIG. 10, the second cartridge body 231 has a second sub-bottom wall 248 which is positioned upward of the second bottom wall 242 and extends rearward to be continuously connected to the lower end portion of the second front wall 240. The rear end portion of the second sub-bottom wall 248 is positioned rearward of the front end portion of the second ink supply portion 234. Both the second bottom wall 242 and second sub-bottom wall 248 are connected to the second sub-front wall 249. The second sub-front wall 249 extends upward from the front end portion of the second bottom wall 242 and downward from the rear end portion of the second sub-bottom wall 248. The second ink supply portion 234 extends frontward from the second sub-front wall 249 at a position downward of the second sub-bottom wall 248 and upward of the second bottom wall 242. Each of the second side walls 237 and 238 connects the second front wall 240, second sub-bottom wall 248, second sub-front wall 249, second bottom wall 242, and second rear wall 241. Each of the second side walls 237 and 238 extends in the front-rear direction and up-down direction.

As illustrated in FIG. 10, a second protrusion 243 is formed on the second upper wall 239 of the second cartridge body 231. Although not illustrated in FIG. 10, like the protrusion 43 of the ink cartridge 30, the second protrusion 243 extends in the front-rear direction at a position offset from the center of the second upper wall 239 in the left-right direction. A surface of the second protrusion 243 that faces rearward is the second locking surface 351. The second locking surface 351 is positioned upward of the second upper wall 239 of the second cartridge body 231. The second locking surface 351 extends in the up-down direction. In a state where the small capacity ink cartridge 230 is attached to the cartridge-attachment section 110, the second locking surface 351 is a surface that can contact the front portion of the lock shaft 145. The contact between the second locking surface 351 and the front portion of the lock shaft 145 allows the small capacity ink cartridge 230 to be held against the biasing force of the coil spring 78, in a state where movement of the small capacity ink cartridge 230 in the rearward direction 52 is restricted in the cartridge-attachment section 110, i.e., in the attached position. The second locking surface 351 is an example of an access portion or first access portion.

In the second protrusion 243, a second horizontal surface 354 is positioned frontward of the second locking surface 351 so as to be continuously connected to the second locking surface 351. The second horizontal surface 354 extends in the left-right direction and front-rear direction. In the second protrusion 243, a second inclined surface 355 is positioned frontward of the second horizontal surface 354 so as to continue from the second horizontal surface 354. The second inclined surface 355 faces upward and frontward. The second inclined surface 355 is inclined such that the front end portion thereof is positioned downward of the rear end portion thereof. The second locking surface 351 and second inclined surface 355 are continuously connected to each other through the second horizontal surface 354, so that a boundary edge between the second locking surface 351 and the second inclined surface 355 does not constitute a ridge-like shape. In the process of insertion of the small capacity ink cartridge 230 by way of the second inclined surface 355 and horizontal surface 354 into the cartridge-attachment section 110, the lock shaft 145 is smoothly guided to the rear side of the second locking surface 351 while abutting against the second inclined surface 355 and second horizontal surface 354.

A second operation portion 290 is formed on the second upper wall 239 of the second cartridge body 231 at a position rearward of the second locking surface 351. A second sub-upper surface 291 is formed rearward of the second upper wall 239 of the second cartridge body 231 so as to be positioned downward of the outer surface positioned at the center portion of the second upper wall 239 in the front-rear direction. The second operation portion 290 is disposed upward of the second sub-upper surface 291 with a space therebetween. The second operation portion 290 has a flat plate-like shape, and protrudes upward from the boundary between the second upper wall 239 and the second sub-upper surface 291. Further, the second operation portion 290 protrudes up to substantially the same level as the second protrusion 243. The upper end position of the second operation portion 290 is positioned frontward of the lower end position thereof. A rib 294 is formed between the second operation portion 290 and the second sub-upper surface 291. The rib 294 is continuously connected to the second operation portion 290 and the second sub-upper surface 291 and extends rearward. The dimension of the rib 294 in the left-right direction is smaller than dimensions of the second operation portion 290 and the second sub-upper surface 291 in the left-right direction. The rear side of the second operation portion 290 is suppressed from being deformed in the up-down direction by the rib 294.

A surface of the second operation portion 290 that faces upward and rearward is a second operation surface 292. The rear side of the second operation surface 292 and the second sub-upper surface 291 extend in the front-rear direction, and overlap each other. In other words, when the small capacity ink cartridge 230 is viewed downward from the upper side thereof, the rear side of the second operation surface 292 and the second sub-upper surface 291 overlap each other. In the second operation surface 292, a plurality of projections, e.g., a plurality of projection ribs 293 extending in the left-right direction are formed spaced apart from one another in the front-rear direction. Existence of the projection ribs 293 allows the user to easily visually recognize the second operation surface 292 and prevents the user's finger from slipping on the second operation surface 292 when the user operates the second operation surface 292 with his or her finger.

The second operation surface 292 can be visible when the small capacity ink cartridge 230 is viewed downward from the upper side thereof and frontward from the rear side thereof. The second operation surface 292 is a surface for the user to operate to remove the small capacity ink cartridge 230 from the cartridge-attachment section 110. The second operation portion 290 and the second cartridge body 231 are integrally formed. Thus, the second operation portion 290 is fixed to the second cartridge body 231 and is thus not moved (pivoted, for example) relative to the second cartridge body 231. Thus, the force the user applies to the second operation surface 292 is directly transmitted to the second cartridge body 231 maintaining its direction unchanged.

The outer surfaces of the respective second front wall 240, second rear wall 241, second upper wall 239, second bottom wall 242, and second side walls 237, 238 of the small capacity ink cartridge 230 each need not necessarily constitute one plane. That is, surfaces that can be visually recognized when the small capacity ink cartridge 230 in the attached posture or the upright posture is viewed rearward from the front side thereof and positioned frontward of the front-rear center of the small capacity ink cartridge 230 are the outer surfaces of the second front wall 240. Surfaces that can be visually recognized when the small capacity ink cartridge 230 in the attached posture or the upright posture is viewed frontward from the rear side thereof and positioned rearward of the front-rear center of the small capacity ink cartridge 230 is the outer surface of the second rear wall 241. Surfaces that can be visually recognized when the small capacity ink cartridge 230 in the attached posture or the upright posture is viewed downward from the upper side thereof and positioned upward of the up-down center portion of the small capacity ink cartridge 230 are the outer surfaces of the second upper wall 239. Surfaces that can be visually recognized when the small capacity ink cartridge 230 in the attached posture or the upright posture is viewed upward from the lower side thereof and positioned downward of the up-down center portion of the small capacity ink cartridge 230 are the outer surfaces of the second bottom wall 242. The same can be said for the outer surfaces of the respective second side walls 237 and 238.

As illustrated in FIG. 10, the second light-blocking plate 267 protrudes upward from the outer surface of the second upper wall 239. The second light-blocking plate 267 extends in the front-rear direction. The second light-blocking plate 267 is positioned frontward of the second protrusion 243. The second light-blocking plate 267 is positioned frontward of a second IC board 264 to be described later.

The second light-blocking plate 267 shields the light of the optical sensor 113 that travels in the left-right direction. More specifically, when the light emitted or irradiated from the light emitter of the optical sensor 113 hits the second light-blocking plate 267 before it reaches the light receiver, the intensity of the light that reaches the light receiver is reduced to less than a predetermined intensity, e.g., zero. The second light-blocking plate 267 may completely shield light traveling in the left-right direction, may partially attenuate light, may bend the traveling direction of light, or may totally reflect light. Meanwhile, the second light-blocking plate 267 does not have a cut corresponding to the cutout 66 formed in the ink cartridge 30. Depending on the presence or absence of the cutout 66, the user or the printer 10 can determine which one of the ink cartridge 30 and small capacity ink cartridge 230 is attached to the cartridge-attachment section 110. The second light-blocking plate 267 is an example of an access portion or first access portion.

As illustrated in FIG. 10, the second IC board 264 is provided on the outer surface of the second upper wall 239 and between the second light-blocking plate 267 and the second protrusion 243. The second IC board 264 is electrically connected to the contacts 106 in the process of attachment of the small capacity ink cartridge 230 to the cartridge-attachment section 110 and also in a state where the small capacity ink cartridge 230 is attached to the cartridge-attachment section 110.

The second IC board 264 has a substrate, a second IC (not illustrated), and four second electrodes 265. The substrate supports the second IC. The four second electrodes 265 are formed on the substrate. The four second electrodes 265 and second IC are electrically connected to each other. Each of the four second electrodes 265 extends in the front-rear direction, and is arranged in the left-right direction. The four second electrodes 265 are exposed to the upper surface of the second IC board 264 so as to be electrically accessible. This allows each of the four contacts 106 of the cartridge case 101 and each of the four second electrodes 265 to be brought into direct contact with each other. The second IC is an integrated circuit and readably stores data indicating information concerning the small capacity ink cartridge 230, including, e.g., a lot number, a manufacturing date, and an ink color. The substrate may be a so-called rigid substrate, or a flexible substrate having flexibility. The second IC board 264 is an example of an access portion or first access portion.

An upper-side second sub-front wall 295 extends downward from the front end portion of the second upper wall 239. The outer surface of the upper-side second sub-front wall 295 faces frontward. A second atmosphere communication port 296 is formed in the upper-side second sub-front wall 295. The second atmosphere communication port 296 is opened to the upper-side second sub-front wall 295. In the process of attachment of the small capacity ink cartridge 230 to the cartridge-attachment section 110, the rod 125 enters the second atmosphere communication port 296. The rod 125 entering the second atmosphere communication port 296 moves a valve 297 backward that seals the second atmosphere communication port 296 against the biasing force of the coil spring 298. Then, the valve 297 moved backward is separated from the second atmosphere communication port 296, whereby the first small capacity storage chamber 232 is opened to the atmosphere.

<Internal Configuration of Second Cartridge body 231>

As illustrated in FIG. 11, the first small capacity storage chamber 232, second small capacity storage chamber 233, a second ink valve chamber 235, and a second atmospheric valve chamber 236 are formed inside the second cartridge body 231. Further, the second cartridge body 231 has inside thereof a second partitioning wall 244 and a second partitioning wall 245. The second partition wall separates the first small capacity storage chamber 232 and second atmospheric valve chamber 236. The second partitioning wall 245 separates the first small capacity storage chamber 232 and second small capacity storage chamber 233. Each of the second partitioning walls 244 and 245 extends in the front-rear direction and the left-right direction. The second partitioning walls 244 and 245 are disposed opposite to each other in the up-down direction. The second partitioning wall 244 crosses the second sub-front wall 249.

The capacity of the first small capacity storage chamber 232 is smaller than that of the first storage chamber 32 of the ink cartridge 30. The upper end portion of the first small capacity storage chamber 232 is defined by the lower surface of the second partitioning wall 244, and the lower end portion of the first small capacity storage chamber 232 is defined by the inner surface of the second sub-bottom wall 248 and the upper surface of the second partitioning wall 245. The front end portion of the first small capacity storage chamber 232 is defined by the inner surface of the second front wall 240, and the rear end portion of the first small capacity storage chamber 232 is defined by the inner surface of the second rear wall 241. Both the side ends of the first small capacity storage chamber 232 are defined by the inner surfaces of the respective second side walls 237 and 238. That is, the first small capacity storage chamber 232 is a space defined by the lower surface of the second partitioning wall 244, inner surface of the second sub-bottom wall 248, upper surface of the second partitioning wall 245, inner surface of the second front wall 240, inner surface of the second rear wall 241, and inner surfaces of the second side walls 237 and 238. At the time of manufacturing of the small capacity ink cartridge 230, ink stored in the first small capacity storage chamber 232 contacts the inner surface of the second sub-bottom wall 248, upper surface of the second partitioning wall 245, inner surface of the second front wall 240, inner surface of the second rear wall 241, and inner surfaces of the respective second side walls 237 and 238. The length of the second sub-bottom wall 248 in the front-rear direction is smaller than the length of the sub bottom wall 48 of the ink cartridge 30 in the front-rear direction. Thus, the capacity of the first small capacity storage chamber 232 is smaller than the capacity of the first storage chamber 32 of the ink cartridge 30.

A second through hole 246 is formed in the second partitioning wall 244. The first small capacity storage chamber 232 and second atmospheric valve chamber 236 communicate with each other through the second through hole 246.

In the inner space of the second cartridge body 231, the second small capacity storage chamber 233 stores ink, and is positioned downward of the first small capacity storage chamber 232 in the use posture. The ink storage capacity of the second small capacity storage chamber 233 is smaller than that of the first small capacity storage chamber 232. The second small capacity storage chamber 233 is positioned between the inner surface of the second sub-front wall 249, the inner surface of the second rear wall 241, and the lower surface of the second partitioning wall 245.

The upper end portion of the second small capacity storage chamber 233 is defined by the lower surface of the second partitioning wall 245 and the lower end portion thereof is defined by the upper surface of the second bottom wall 242. The rear end portion of the second small capacity storage chamber 233 is defined by the inner surface of the second rear wall 241. Both the side ends of the second small capacity storage chamber 233 are defined by the inner surfaces of the second side walls 237 and 238. A second partition wall 250 is formed between the second small capacity storage chamber 233 and the second ink valve chamber 235. The front end portion of the second small capacity storage chamber 233 is defined by a part of the surface of the second partition wall 250 that is close to the second small capacity storage chamber 233. That is, the second small capacity storage chamber 233 is a space defined by the lower surface of the second partitioning wall 245, upper surface of the second bottom wall 242, inner surface of the second rear wall 241, inner surfaces of the respective second side walls 237 and 238, and a part of the surface of the second partition wall 250 that is close to the second small capacity storage chamber 233. The capacity of the second small capacity storage chamber 233 is the same as that of the second storage chamber 33 of the ink cartridge 30.

Here, the lower surface of the second partitioning wall 245 has an ink facing region configured to contact with ink in the storage chamber 33 or 232 having an area equivalent to the area of the ink facing region in the lower surface of the partitioning wall 45; the area of the ink facing region in the upper surface of the second bottom wall 242 is equivalent to that of the ink facing region in the upper surface of the bottom wall 42; the area of the ink facing region in the inner surface of the second rear wall 241 is equivalent to that of the ink facing region in the inner surface of the rear wall 41; the areas of the ink facing regions inner surfaces of the respective second side walls 237 and 238 are equivalent to those of the ink facing regions in the inner surfaces of the respective side walls 37 and 38, respectively; the area of the ink facing region in the second partition wall 250 is equivalent to that of the ink facing region in the partition wall 50. Therefore, the capacity of the second small capacity storage chamber 233 is the same as that of the second storage chamber 33 of the ink cartridge 30.

The second small capacity storage chamber 233 is in communication with the first small capacity storage chamber 232 through a second communication port 247 formed in the second partitioning wall 245. The second small capacity storage chamber 233 is in communication with the second ink valve chamber 235 through a through hole 99 formed in the second partition wall 250. The communication port 247 is an example of a communication opening.

The valve 297 and coil spring 298 are housed in the second atmospheric valve chamber 236. The second atmospheric valve chamber 236 communicates with the atmosphere through the second atmosphere communication port 296 formed so as to penetrate the upper-side second sub-front wall 295. The valve 297 is movable between a closing position where the valve 297 seals the second atmosphere communication port 296 and an opening position where the valve 297 is separated from the second atmosphere communication port 296. The coil spring 298 is disposed so as to be expandable or contractible in the front-rear direction and biases the valve 297 in a direction in which the valve 297 abuts against the second atmosphere communication port 296, i.e., in the frontward direction 51.

The second ink supply portion 234 (an example of a second liquid supply portion) has a cylindrical outer shape. More specifically, the second ink supply portion 234 has a packing 276 and a second cylinder 275 having an open front end portion. The second cylinder 275 is disposed downward of the second sub-bottom wall 248 and protrudes frontward from the second sub-front wall 249. The inner space of the second cylinder 275 serves as the second ink valve chamber 235. The front end portion of the second cylinder 275 has an opening opened to the outside of the small capacity ink cartridge 230. The packing 276 is positioned at the front end portion of the second cylinder 275.

A valve 277 and the coil spring 278 are housed in the second ink valve chamber 235. The valve 277 is moved in the front-rear direction to open and close the second ink supply port 271 penetrating the center of the packing 276. The coil spring 278 biases the valve 277 frontward. Accordingly, in a state where external force is not applied, the valve 277 closes the second ink supply port 271 of the packing 276. The capacity of the second ink valve chamber 235 is the same as that of the ink valve chamber 35 of the ink cartridge 30. This is because the capacity of the inner space of the second cylinder 275 is the same as that of the inner space of the cylinder 75 of the ink cartridge 30. Further, the length of the second ink valve chamber 235 in the front-rear direction is the same as the length of the ink valve chamber 35 in the front-rear direction. More specifically, the length of the cylinder 75 in the front-rear direction is the same as the length of the second cylinder 275 in the front-rear direction.

The packing 276 is a disk-shaped member having a through hole at the center thereof. The packing 276 is made of an elastic material such as rubber or elastomer. A tubular inner peripheral surface is formed so as to penetrate the center of the packing 276 in the front-rear direction. By the tubular inner peripheral surface, the second ink supply port 271 is formed in the packing 276. The inner diameter of the second ink supply port 271 is slightly smaller than the outer diameter of the ink needle 102.

When the small capacity ink cartridge 230 is inserted into the cartridge-attachment section 110 in a state where the valve 277 closes the second ink supply port 271, the ink needle 102 enters the second ink supply port 271. The ink needle 102 elastically deforms the packing 276, and the outer peripheral surface thereof liquid-tightly contacts the inner peripheral surface defining the second ink supply port 271. When the leading end portion of the ink needle 102 passes through the second ink supply port 271 formed in the packing 276 and enters the second ink valve chamber 235, it abuts against the valve 277. When the small capacity ink cartridge 230 is further inserted into the cartridge-attachment section 110, the ink needle 102 moves the valve 277 rearward against the biasing force of the coil spring 278. This allows ink stored in the second ink valve chamber 235 to flow into the inner space of the ink needle 102.

<Second Communication Port 247>

Figure 13A:
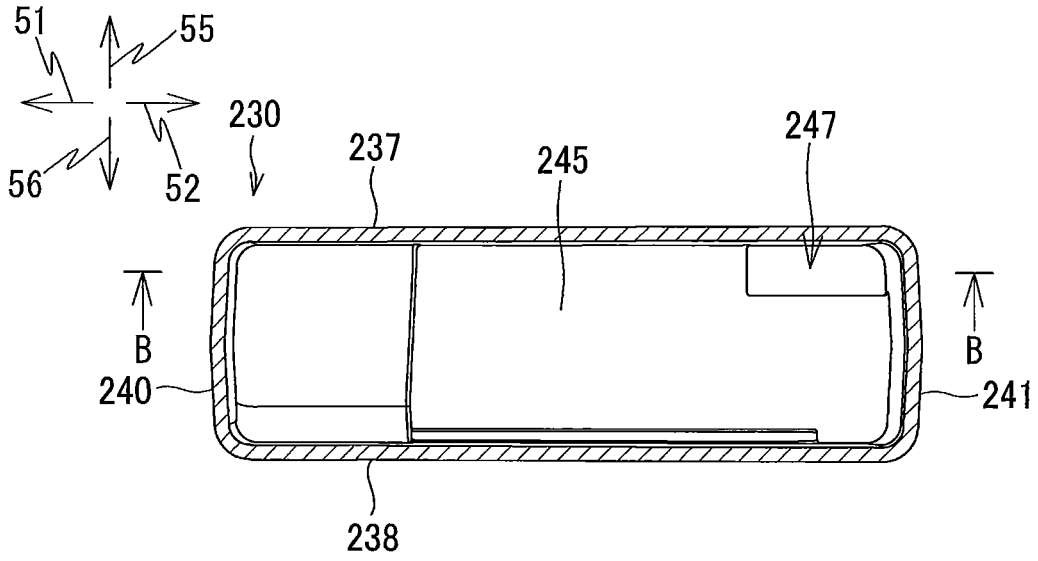
FIG. 13A is a cross-sectional view of the ink cartridge according to the embodiment taken along a horizontal plane in an upright posture.
Figure 13B:
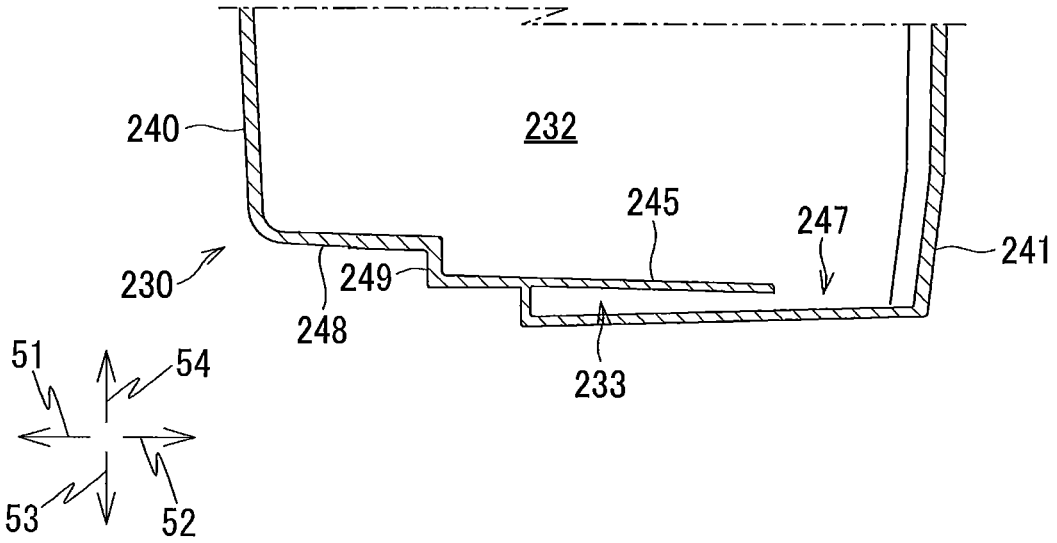
FIG. 13B is a cross-sectional view of the ink cartridge according to the embodiment taken along a vertical plane in the upright posture.

As illustrated in FIG. 13, similar to the communication port 47 of the ink cartridge 30, the second communication port 247 is formed in the second partitioning wall 245. The first small capacity storage chamber 232 and the second small capacity storage chamber 233 are in communication with each other by the second communication port 247 so that ink can flow therebetween. In the use posture of the small capacity ink cartridge 230, the second communication port 247 is disposed adjacent to the end portion in the left-right direction of the inner surface of the second rear wall 241 in the second cartridge body 231. The second communication port 247 is defined by the inner surface of the second rear wall 241, inner surface of the second side wall 237, and the end surface of the second partitioning wall 245. The end surface of the second partitioning wall 245 connects the upper and lower surfaces thereof. The upper end portion of the second communication port 247 is formed by the upper surface of the second partitioning wall 245 and inner surface of the second rear wall 241. In the use posture, the upper surface of the second partitioning wall 245 is inclined downward toward the second communication port 247 in the left-right direction. That is, the right end portion of the upper surface of the second partitioning wall 245 is positioned downward of the left end thereof.

Further, as illustrated in FIG. 11, in the use posture, the upper surface of the second partitioning wall 245 is inclined downward toward the second communication port 247 in the front-rear direction. That is, the front end portion of the upper surface of the second partitioning wall 245 is positioned upward of the rear end portion thereof. Further, the inner surface of the second sub-bottom wall 248 is inclined so that the rear end portion thereof is downward of the front end portion thereof.

<Arrangement of Parts in Small Capacity Ink Cartridge 230>

As illustrated in FIG. 10, a length L3 of the second front wall 240 in the up-down direction is larger than a length L4 of the second sub-front wall 249 in the up-down direction (L3>L4). The second front wall 240 is positioned frontward of the second ink supply port 271 in the front-rear direction. In other words, the second ink supply port 271 is disposed at a position overlapping the second sub-bottom wall 248 in the up-down direction and downward of the second sub-bottom wall 248. Further, the second front wall 240 is positioned frontward of the second atmosphere communication port 296 in the front-rear direction. Further, the second light-blocking plate 267, second IC board 264, and second locking surface 351 are positioned rearward of the second atmosphere communication port 296 in the front-rear direction.

As illustrated in FIG. 10, the length of the small capacity ink cartridge 230 in the front-rear direction is smaller than the length of the ink cartridge 30 in the front-rear direction. Particularly, the length of the sub bottom wall 48 of the ink cartridge 30 in the front-rear direction is larger than the length of the second sub-bottom wall 248 of the small capacity ink cartridge 230 in the front-rear direction. Accordingly, the ink storage capacity of the small capacity ink cartridge 230 and the ink storage capacity of the ink cartridge 30 differ from each other. More specifically, the capacity of the first storage chamber 32 is larger than that of the first small capacity storage chamber 232. The capacity of the second small capacity storage chamber 233 and that of the second storage chamber 33 are the same. Further, the capacity of the second ink valve chamber 235 and that of the ink valve chamber 35 are the same.

Further, the length of the small capacity ink cartridge 230 in the up-down direction is the same as the length of the ink cartridge 30 in the up-down direction. Further, the length of the small capacity ink cartridge 230 in the left-right direction is the same as the length of the ink cartridge 30 in the left-right direction. Further, the length of the second bottom wall 242 of the small capacity ink cartridge 230 in the front-rear direction is the same as the length of the bottom wall 42 of the ink cartridge 30 in the front-rear direction.

Thus, a position P3 of the rear wall 41 in a state where the ink cartridge 30 is attached to the cartridge-attachment section 110 and a position P4 of the second rear wall 241 in a state where the small capacity ink cartridge 230 is attached to the cartridge-attachment section 110 are the same. On the other hand, a position P1 of the front wall 40 in a state where the ink cartridge 30 is attached to the cartridge-attachment section 110 and a position P2 of the second front wall 240 in a state where the small capacity ink cartridge 230 is attached to the cartridge-attachment section 110 are different. FIG. 10 illustrates the positional relationship between the ink cartridge 30 and the small capacity ink cartridge 230 in their attachment states. In FIG. 10, the dashed line denotes the front wall 40 and sub bottom wall 48 of the ink cartridge 30. As illustrated in FIG. 10, the position P1 of the front wall 40 in the front-rear position with respect to the front end portion of the ink supply port 71 of the ink cartridge 30 is positioned frontward of the position P2 of the second front wall 240 in the front-rear position with respect to the front end portion of the second ink supply port 271 of the small capacity ink cartridge 230. In a state where the ink cartridge 30 or small capacity ink cartridge 230 is attached to the cartridge-attachment section 110, the position of the ink supply port 71 in the front-rear direction and the position of the second ink supply port 271 in the front-rear direction are the same, so that, in FIG. 10, the position of the ink supply port 71 is the same as the position of the second ink supply port 271.

That is, the length between the front wall 40 and the ink supply port 71 in the frontward direction is longer than the length between the second front wall 240 and the second ink supply port 271 in the frontward direction.

The position of the rear wall 41 in the front-rear direction with respect to the front end portion of the ink supply port 71 of the ink cartridge 30 is defined as the position P3. The position of the second rear wall 241 in the front-rear direction with respect to the front end portion of the second ink supply port 271 of the small capacity ink cartridge 230 is assumed to be the position P4. The position P3 and the position P4 are the same. That is, the length between the rear wall 41 and the ink supply port 71 in the frontward direction is equivalent to the length between the rear wall 241 and the second ink supply port 271 in the frontward direction.

As illustrated in FIG. 11, the position of the atmosphere communication port 96 in the front-rear direction with respect to the front end portion of the ink supply port 71 of the ink cartridge 30 is defined as a position P5. The position of the second atmosphere communication port 296 in the front-rear direction with respect to the front end portion of the second ink supply port 271 of the small capacity ink cartridge 230 is assumed to be a position P6. The position P5 and the position P6 are the same. That is, the length between the front end part of the ink supply port 71 and the atmosphere communication port 96 in the frontward direction is equivalent to the length between the front end part of the second ink supply port 271 and the second atmosphere communication port 296 in the frontward direction.

The positions of the light-blocking plate 67, IC board 64, and locking surface 151 in the front-rear direction with respect to the rear wall 41 of the ink cartridge 30 are the same as the positions of the respective second light-blocking plate 267, second IC board 264, and second locking surface 351 in the front-rear direction with respect to the second rear wall 241 of the small capacity ink cartridge 230, respectively.

That is, the light-blocking plate 67, IC board 64, and locking surface 151, i.e. first access portions, define first lengths with respect to the rear wall 41 in the frontward direction. On the other hand, the second light-blocking plate 267, second IC board 264, and second locking surface 351, i.e. second access portions, define second lengths with respect to the second rear wall 241 in the frontward direction. The first lengths of the first access portions are equivalent to corresponding second lengths of the second access portions.

In the ink cartridge 30 illustrated in FIG. 3, the ink supply port 71, IC board 64, light-blocking plate 67, atmosphere communication port 96, and locking surface 151 define positions A as relative positions with respect to the ink needle 102, contacts 106, optical sensor 113, rod 125, and lock shaft 145 of the cartridge-attachment section 110, respectively.

On the other hand, in the small capacity ink cartridge 230 illustrated in FIG. 12, the respective second ink supply port 271, second IC board 264, second light-blocking plate 267, second atmosphere communication port 296, and second locking surface 351 define positions B as relative positions with respect to the ink needle 102, contacts 106, optical sensor 113, rod 125, and lock shaft 145 of the cartridge-attachment section 110, respectively. The positions A and positions B coincide with each other.

<Modifications>

In the following, various modifications to the depicted embodiment will be described. Like parts and components will be designated with the same reference numerals as those of the depicted embodiment to avoid duplicating explanation.

In the above-described embodiment, the ink cartridge 30 and the small capacity ink cartridge 230 have first and second chambers 32, 232, 33, and 233. However, the ink cartridge needs not necessarily have the first and second chambers as described in the following modification. In the above-described embodiment, the cartridge case 101, 201 has an upper part that has the upper wall 39, 239 and a lower part that has the bottom wall and side walls 42, 242, 37, 38, 237, 238; and the upper part is attached to the lower part. Alternatively, the ink cartridge may include a cartridge case that integrally includes an upper part and a lower part and has a storage chamber defined by upper, side, and bottom walls thereof, as described in the following modification.

Figure 14A:
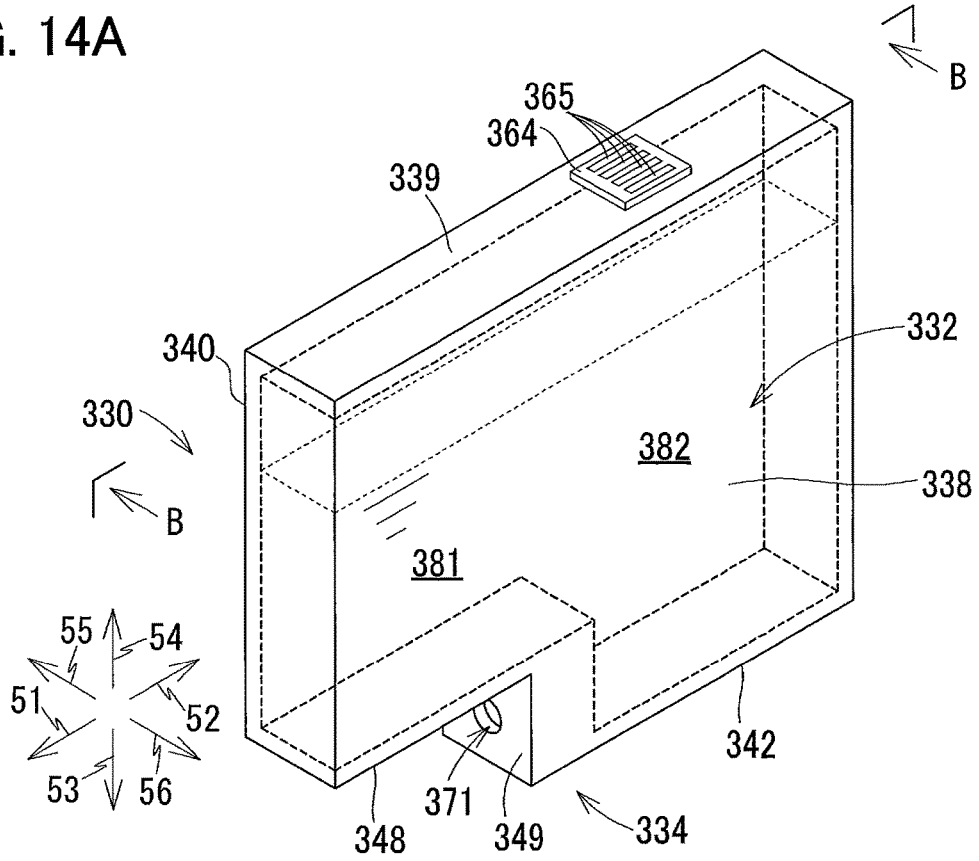
FIG. 14A is a perspective view of an ink cartridge according to a modification when viewed from a perspective frontward and upward thereof.
Figure 14B:
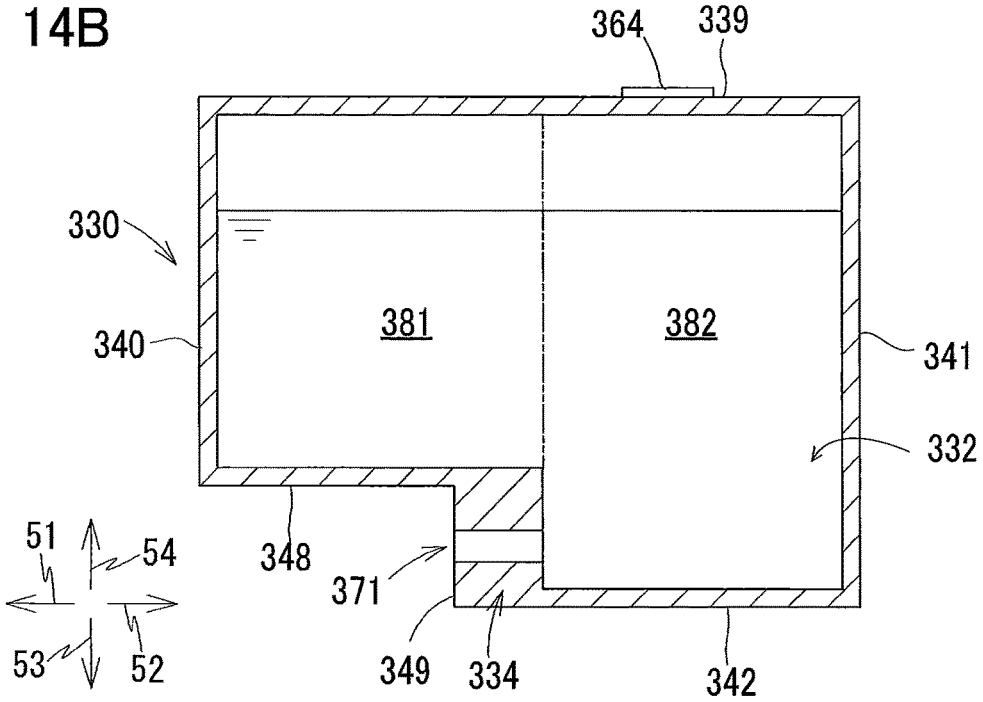
FIG. 14B is cross-sectional view of the ink cartridge according to the modification taken along a vertical plane in the upright posture.

FIGS. 14A and 14B illustrate an ink cartridge 330 according to the modification of the embodiment. The ink cartridge 330 has an ink chamber 332, and the ink chamber 332 has a first space 381 and a second space 382 positioned rearward relative to the first space in the upright posture as illustrated by a phantom line in FIG. 14B. The first space 381 is defined by the front, side, and sub bottom walls 340, 337, 338, and 348. The second space 382 is defined by the rear and side walls 341, 337, and 338. The first space 381 has a left-right dimension in the left-right direction, and the left-right dimension of the first space 381 is substantially the same as the left-right dimension of the second space 382. The IC board 64 in its entirety is overlapped with the second space 382 of the liquid chamber in the gravitational direction in the upright posture. The front wall 340 has a length in the upward direction longer than a length of the sub front wall 349 in the upward direction in the upright posture.

The following describe other modifications to the embodiment. In the above-described embodiment, the cartridge body 31 and second cartridge body 231, at least the rear wall 41 and second rear wall 241 have translucency allowing the liquid surface of ink stored in the first and second storage chambers 32 and 33 and the first and second small capacity storage chambers 232 and 233 to be visible from outside. However, the cartridge body 31 and second cartridge body 231 need not necessarily have translucency.

The ink supply port 71 and second ink supply port 271 may be sealed by a film in place of the respective valve 77 and valve 277. Further, the ink supply port 71 and second ink supply port 271 may be formed by piercing a needle into a seal member made of elastic resin having no through hole. In this case, when the needle is removed from the seal member, the opening is sealed by the elasticity of the seal member. Further, the ink supply portion 34 and second ink supply portion 234 need not be realized as a cylindrical member. For example, a through hole formed in the front wall 40 of the cartridge body 31 or in the second front wall 240 of the second cartridge body 231 may be constituted as the ink supply part.

Further, in the above-described embodiment, ink is used as an example of liquid; however, the present disclosure is not limited to this. For example, in place of ink, pretreatment liquid to be ejected, prior to ink, onto a paper sheet at printing may be stored in a liquid cartridge. Further, water for cleaning the recording head 21 may be stored in the liquid cartridge.

<Functions and Effects>

In the ink cartridge 30, most of the ink stored in the first storage chamber 32 is positioned above the ink supply port 71, so that the centroid or the center of gravity G of the ink cartridge 30 is comparatively close to the ink supply port 71 as illustrated in FIG. 7. As a result, in a state where the ink needle 102 is inserted into the ink supply port 71, the center of gravity G of the ink cartridge 30 is comparatively close to the ink needle 102, so that the weight of the ink cartridge 30 hardly acts as a force twisting the tube. As a result, the connection state between the ink supply port 71 and the ink needle 102 becomes stable, thereby preventing the liquid from leaking from the connecting part between the ink needle 102 and the ink supply port 71. Further, the center of gravity G of the ink cartridge 30 is comparatively close to the locking surface 151, so that the posture of the ink cartridge 30 engaged with the cartridge-attachment section 110 becomes stable. The same can be said for the small capacity ink cartridge 230.

Further, in the ink cartridge 30, the front wall 40 is positioned frontward of the atmosphere communication port 96, so that the inner space of the cartridge body 31 positioned rearward of the front wall 40 and upward of the sub bottom wall 48 can be used as a part of the first storage chamber 32. Thus, the space of the cartridge body 31 positioned rearward of the front wall 40 and upward of the sub bottom wall 48 can be used as the space dedicated for the first storage chamber 32, thereby effectively increasing the capacity of the first storage chamber 32. The same can be said for the small capacity ink cartridge 230. Further, by making the structure of a part of the cartridge body 31, exclusive of the space positioned rearward of the front wall 40 and upward of the sub bottom wall 48, common to that of the second cartridge body 231 of the small capacity ink cartridge 230, a die can be shared between the ink cartridge 30 and small capacity ink cartridge 230. In other words, only by differentiating the length of the sub bottom wall 48 of the ink cartridge 30 in the front-rear direction from the length of the second sub-bottom wall 248 of the small capacity ink cartridge 230, the capacity of the storage chamber (32, 232) can be changed, thus facilitating the sharing of a die.

Further, the light-blocking plate 67, IC board 64, and locking surface 151 are disposed rearward of the atmosphere communication port 96 on the upper wall 39 of the cartridge body 31, whereby a part of the cartridge body 31 positioned frontward of the atmosphere communication port 96 can be utilized to the maximum extent as a space for the first storage chamber 32. The same can be said for the small capacity ink cartridge 230. In other words, it is only necessary to change the presence or absence of the front-side sub-upper surface 91 in the upper part of the ink cartridge (30, 230), thus facilitating the sharing of a die.

Further, in the ink cartridge 30, the first storage chamber 32 is partitioned by the sub bottom wall 48 having the inner surface whose rear end portion is positioned downward of the front end portion. Accordingly, liquid stored in the first storage chamber 32 easily flows downward due to the inclination of the inner surface. The same can be said for the small capacity ink cartridge 230.

Further, in the ink cartridge 30, the front end portion of the upper surface of the partitioning wall 45 is positioned downward of the rear end portion of the inner surface of the sub bottom wall 48, and the upper surface of the partitioning wall 45 is inclined downward toward the communication port 47. Accordingly, ink stored in the first storage chamber 32 easily flows toward the second storage chamber 33. The same can be said for the small capacity ink cartridge 230.

Further, in the ink cartridge 30, the rear wall 41 has translucency allowing the liquid surface in the first storage chamber 32 to be visible. Accordingly, in a state where the ink cartridge 30 is attached to the cartridge-attachment section 110, the liquid surface in the first storage chamber 32 can be viewed through the rear wall 41. The same can be said for the small capacity ink cartridge 230.

Further, the position P1 of the front wall 40 in the front-rear direction with respect to the ink supply port 71 in the ink cartridge 30 is frontward of the position P2 of the second front wall 240 in the front-rear direction with respect to the second ink supply port 271 in the small capacity ink cartridge 230. Accordingly, the capacity of the storage chamber 32 can be changed without influencing the position of the rear wall 41 of the ink cartridge 30 attached to the cartridge-attachment section 110. Further, the capacity of the storage chamber 232 can be changed without influencing the position of the second rear wall 241 of the small capacity ink cartridge 230 attached to the cartridge-attachment section 110.

Further, the position P3 of the rear wall 41 in the front-rear direction with respect to the front end portion of the ink supply port 71 in the ink cartridge 30 is the same as the position P4 of the second rear wall 241 in the front-rear direction with respect to the front end portion of the second ink supply port 271 in the small capacity ink cartridge 230. Accordingly, the position of the rear wall 41 of the ink cartridge 30 and the position of the second rear wall 241 of the small capacity ink cartridge 230 when attached to the cartridge-attachment section 110 are the same.

While the description has been made in detail with reference to specific embodiment(s) thereof, it would be apparent to those skilled in the art that various changes and modifications may be made therein without departing from the spirit and scope of the above described embodiment(s).

What is claimed is:

1. A liquid cartridge comprising:

a liquid chamber configured to store liquid;

a liquid supply portion having a front end part formed with a liquid supply hole through which the liquid is configured to flow out from the liquid chamber in a frontward direction crossing a gravitational direction in an upright posture;

a front wall and a rear wall away from the front wall in a rearward direction opposite to the frontward direction in the upright posture;

a lower-side sub front wall at which the liquid supply portion is provided, the lower-side sub front wall facing frontward and being positioned closer to the front wall in the frontward direction than to the rear wall, the lower-side sub front wall being positioned downward relative to the front wall;

an upper wall positioned between the front wall and the rear wall and extending in a direction parallel with both of the frontward direction and the rearward direction;

a bottom wall extending between the lower-side sub front wall and the rear wall;

a sub bottom wall extending between the front wall and the lower-side sub front wall in the frontward direction, the sub bottom wall positioned upward relative to the liquid supply portion;

a pair of side walls each connecting the front wall, the sub bottom wall, the lower-side sub front wall, and the bottom wall, each of the pair of side walls extending frontward, rearward, upward, and downward in the upright posture; and an IC board configured to electrically contact with a contact provided in a cartridge-attachment section into which the liquid cartridge is inserted frontward, the front wall being positioned frontward relative to a front end part of the liquid supply hole, the front wall having a length in an upward direction longer than a length of the lower-side sub front wall in the upward direction in the upright posture, the upward direction being opposite to the gravitational direction, wherein the liquid chamber includes a first space and a second space in communication with each other, the first space being defined by inner surfaces of the front wall, the sub bottom wall, and portions of the pair of side walls that extend from the front wall in the rearward direction to a position where the sub bottom wall is connected with the lower-side sub front wall, the second space being defined by inner surfaces of the lower-side sub front wall, the bottom wall, the rear wall, and portions of the pair of side walls that extend from the rear wall in the frontward direction to a position where the bottom wall is connected with the lower-side sub front wall, the second space being positioned rearward relative to the first space, and wherein the first space and the second space have dimensions in a left-right direction perpendicular to the frontward direction and the gravitational direction in the upright posture, the dimensions of the first space and the second space in the left-right direction being the same as a dimension of an inner surface of the front wall in the left-right direction, and wherein the IC board is positioned upward relative to the upper wall, the IC board in its entirety being overlapped with the second space in the gravitational direction.

2. The liquid cartridge according to claim 1, further comprising an upper-side sub front wall facing frontward and being positioned upward and rearward relative to the front wall, wherein the upper-side sub front wall has an opening connected to an air communication port, the liquid chamber being in communication with an outside of the liquid cartridge through the air communication port.

3. The liquid cartridge according to claim 2, further comprising:

an upper wall connecting upper-side sub the front wall and the rear wall and positioned upward relative to the upper-side sub front wall; and an access portion accessible from the outside of the liquid cartridge and disposed at the upper wall at a position rearward relative to the opening.

4. The liquid cartridge according to claim 3, wherein the access portion is a locking surface configured to be engaged with a locked portion of a cartridge-attachment section into which the liquid cartridge is inserted frontward, the locking surface being configured to engage with the locked portion so as to restrict the liquid cartridge from moving rearward.

5. The liquid cartridge according to claim 3, wherein the access portion is an IC board configured to electrically contact with a contact provided in a cartridge-attachment section into which the liquid cartridge is inserted frontward.

6. The liquid cartridge according to claim 3, wherein the access portion is a light-blocking plate configured to be detected by an optical sensor provided in a cartridge-attachment section into which the liquid cartridge is inserted frontward.

7. The liquid cartridge according to claim 1, wherein the inner surface of the sub bottom wall has a forward end portion and a rearward end portion, the liquid chamber having a portion partitioned by at least the inner surface of the sub bottom wall, the inner surface of the sub bottom wall in the upright posture being inclined such that the rearward end portion of the inner surface of the sub bottom wall is positioned downward relative to the forward end portion of the inner surface of the sub bottom wall.

8. The liquid cartridge according to claim 7, further comprising a partition wall crossing the lower-side sub front wall and having an upper surface and a lower surface, the partition wall being formed with a communication opening; and wherein the liquid chamber comprises:

a first liquid chamber defined by the inner surfaces of the front wall, the sub bottom wall, the pair of side walls, and the rear wall and the upper surface of the partition wall; and a second liquid chamber positioned between the inner surfaces of the lower-side sub front wall, the bottom wall, the pair of side walls, and the rear wall and the lower surface of the partition wall, the second liquid chamber being in communication with the first liquid chamber through the communication opening such that the liquid flows between the first liquid chamber and the second liquid chamber.

9. The liquid cartridge according to claim 8, wherein the upper surface of the partition wall has a front end portion positioned downward relative to the rearward end portion of the inner surface of the sub bottom wall, the upper surface of the partition wall being inclined downward from the front end portion of the upper surface of the partition wall toward the communication opening.

10. The liquid cartridge according to claim 9, wherein the communication opening has an upper end portion defined by the upper surface of the partition wall and the inner surface of the rear wall.

11. The liquid cartridge according to claim 8, wherein the rear wall has a translucency so that the liquid in the first liquid chamber is visible from the outside.

12. The liquid cartridge according to claim 1, wherein an outer surface of the front wall has a dimension in the left-right direction, and wherein the dimension of the outer surface of the front wall in the left-right direction is the same as a distance between outer surfaces of the pair of side walls in the left-right direction.

13. A set of liquid cartridges comprising:

a plurality of liquid cartridges, each liquid cartridge comprising:

a liquid chamber configured to store liquid;

a liquid supply portion having a front end part formed with a liquid supply hole through which the liquid is configured to flow out from the liquid chamber in a frontward direction crossing a gravitational direction in an upright posture;

a front wall and a rear wall away from the front wall in a rearward direction opposite to the frontward direction in the upright posture;

a lower-side sub front wall at which the liquid supply portion is provided, the lower-side sub front wall facing frontward and being positioned closer to the front wall in the frontward direction than to the rear wall, the lower-side sub front wall being positioned downward relative to the front wall;

a bottom wall extending between the lower-side sub front wall and the rear wall:

a sub bottom wall extending between the front wall and the lower-side sub front wall in the frontward direction, the sub bottom wall positioned upward relative to the liquid supply portion; and a pair of side walls each connecting the front wall, the sub bottom wall, the lower-side sub front wall, and the bottom wall, each of the pair of side walls extending frontward, rearward, upward, and downward in the upright posture, the front wall being positioned frontward relative to a front end part of the liquid supply hole, the front wall having a length in an upward direction longer than a length of the lower-side sub front wall in the upward direction in the upright posture, the upward direction being opposite to the gravitational direction, wherein the liquid chamber includes a first space and a second space in communication with each other, the first space being defined by inner surfaces of the front wall, the sub bottom wall, and portions of the pair of side walls that extend from the front wall in the rearward direction to a position where the sub bottom wall is connected with the lower-side sub front wall, the second space being defined by inner surfaces of the lower-side sub front wall, the bottom wall, the rear wall, and portions of the pair of side walls that extend from the rear wall in the frontward direction to a position where the bottom wall is connected with the lower-side sub front wall, the second space being positioned rearward relative to the first space, and wherein the first space and the second space have dimensions in a left-right direction perpendicular to the frontward direction and the gravitational direction in the upright posture, the dimensions of the first space and the second space in the left-right direction being the same as a dimension of an inner surface of the front wall in the left-right direction, wherein an outer surface of the front wall has a dimension in the left-right direction, and wherein the dimension of the outer surface of the front wall in the left-right direction is the same as a distance between outer surfaces of the pair of side walls in the left-right direction, wherein the dimensions of the outer surfaces of the front walls in the plurality of liquid cartridges in the left-right direction are the same as one another, and wherein distances between the front walls and the liquid supply holes in the plurality of liquid cartridges in the frontward direction are different from one another.

14. The set of liquid cartridges according to claim 13, wherein distances between the rear walls and the liquid supply holes in the plurality of liquid cartridges in the frontward direction are the same as one another.

15. The set of liquid cartridges according to claim 13, wherein each of the plurality of liquid cartridges further comprises an upper-side sub front wall facing frontward and being positioned upward and rearward relative to the front wall, wherein the upper-side sub front wall of each liquid cartridge has an opening connected to an air communication port, the liquid chamber of each liquid cartridge being in communication with an outside of the each liquid cartridge through the air communication port, wherein the liquid supply portion of each liquid cartridge has a front end part formed with the liquid supply hole, and wherein distances between the front end parts of the liquid supply portions and the upper-side sub front walls of the plurality of liquid cartridges in the frontward direction are the same as one another.

16. The set of liquid cartridges according to claim 15, wherein each of the plurality of liquid cartridges further comprises an upper-side sub front wall facing frontward and being positioned upward and rearward relative to the front wall, wherein the upper-side sub front wall of each liquid cartridge has an opening connected to an air communication port, the liquid chamber of each liquid cartridge being in communication with an outside of the each liquid cartridge through the air communication port, wherein each liquid cartridge further comprises:

an upper wall connecting the upper-side sub front wall and the rear wall and positioned upward relative to the upper-side sub front wall; and an access portion accessible from the outside of the each liquid cartridge and disposed at the upper wall at a position rearward relative to the opening, and wherein distances between the access portions and the rear walls in the plurality of liquid cartridges in the frontward direction are the same as one another.

* * * * *